US008631582B2

(12) United States Patent
Takaoka et al.

(10) Patent No.: US 8,631,582 B2
(45) Date of Patent: Jan. 21, 2014

(54) RECIPROCATING ELECTRIC SHAVER

(75) Inventors: Yoichi Takaoka, Kusatsu (JP); Yasuo Ibuki, Hikone (JP); Hiroshi Shigeta, Fujiidera (JP); Yasunori Ueda, Hikone (JP)

(73) Assignee: Panasonic Corporation, Osaka (JP)

( * ) Notice: Subject to any disclaimer, the term of this patent is extended or adjusted under 35 U.S.C. 154(b) by 280 days.

(21) Appl. No.: 13/160,863

(22) Filed: Jun. 15, 2011

(65) Prior Publication Data

US 2012/0005899 A1 Jan. 12, 2012

(30) Foreign Application Priority Data

Jul. 8, 2010 (JP) ..... 2010-156127

(51) Int. Cl.
*B26B 19/02* (2006.01)
*B26B 19/28* (2006.01)

(52) U.S. Cl.
USPC ..... 30/43.92; 30/42

(58) Field of Classification Search
USPC ..... 30/43.92, 43.91, 42, 45, 43.7, 43.2, 30/46.91, 43.1, 43.3
See application file for complete search history.

(56) References Cited

U.S. PATENT DOCUMENTS 5,678,312 A * 10/1997 Watanabe ..... 30/43.92
5,678,313 A * 10/1997 Tezuka et al. ..... 30/43.92
2007/0022607 A1* 2/2007 Takeuchi et al. ..... 30/43.92
2007/0261249 A1* 11/2007 Yamasaki et al. ..... 30/43.7

FOREIGN PATENT DOCUMENTS

JP 2004-016524 1/2004

* cited by examiner

*Primary Examiner* — Ghassem Alie
(74) *Attorney, Agent, or Firm* — Greenblum & Bernstein P.L.C.

(57) ABSTRACT

A reciprocating electric shaver includes: a rotary motor; a pair of driving elements to which inner blades are individually attached; and a conversion mechanism coupled to the rotary motor and the corresponding driving element to convert rotating motion of the rotary motor to reciprocating motion of the pair of driving elements. Each driving element and coupling members coupled to the driving elements constitute driving blocks. The driving blocks include balance adjusters provided on the opposite sides of a rotation axis of the rotary motor from the driving elements included in the driving blocks, respectively.

12 Claims, 18 Drawing Sheets

RECIPROCATING ELECTRIC SHAVER

CROSS REFERENCE TO RELATED APPLICATIONS

This application is based upon and claims the benefit of priority from prior Japanese Patent Application P2010-156127 filed on Jul. 8, 2010; the entire contents of which are incorporated by reference herein.

BACKGROUND OF THE INVENTION

The present invention relates to a reciprocating electric shaver.

One of conventionally known reciprocating electric shavers, as disclosed in Japanese Patent Laid-open Publication No. 2004-016524 (hereinafter, referred to as Patent Literature 1), is provided with a conversion mechanism configured to convert rotating motion of a rotary motor to reciprocating motion, and the conversion mechanism reciprocates a driving element to which an internal blade is attached. Moreover, under the driving element, a balancer is provided to reciprocate at a phase 180 degrees different from that of the driving element.

In Patent Literature 1, the balancer is reciprocated in phase opposite to the driving element to reduce vibration of the driving element in the reciprocating direction.

In the case where two driving elements to which internal blades are attached are arranged side by side, vibration of the driving elements in the reciprocating direction can be reduced by reciprocating the driving elements in phases opposite to each other.

SUMMARY OF THE INVENTION

However, if the two driving elements are reciprocated in opposite phases to each other like the aforementioned conventional technique, moments about the rotational axis of the rotary motor at the driving elements are directed in a same rotational direction. This causes great vibration during operation of the reciprocating electric shaver.

Accordingly, an object of the present invention is to provide a reciprocating electric shaver with vibration reduced even in the case of including a plurality of driving elements arranged side by side.

In order to achieve the aforementioned object, the present invention is a reciprocating electric shaver, including: a rotary motor; a conversion mechanism converting rotating motion of the rotary motor to reciprocating motion; and a pair of driving elements reciprocating in phases opposite to each other, in which the pair of driving elements are individually connected to coupling members operating in conjunction with the reciprocating motions of the driving elements, each of the driving elements and the coupling member connected thereto constitute a driving block, and each driving block includes a balance adjustment portion provided on the opposite side of a rotation axis of the rotary motor from the driving element included in the driving block.

DETAILED DESCRIPTION OF THE PREFERRED EMBODIMENTS

Hereinafter, an embodiment of the present invention will be described in detail with reference to the drawings. In the following description, the direction that a plurality of outer blades are arranged side by side is referred to as a front-back direction (shaving direction) X; the direction that the outer blades extend is referred to as a right-left direction Y; and the vertical direction when the head section is placed with the outer blades facing upward is referred to as an up-down direction Z. The side of a reciprocating electric shaver where a switch portion is provided is referred to as a front side in the front-back direction X.

Figure 1C:
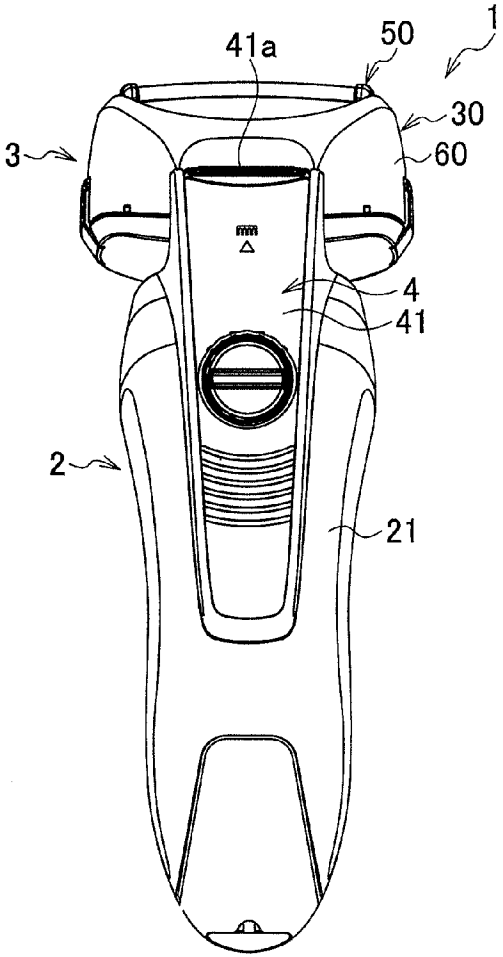
FIGS. 1A to 1C are views showing a reciprocating electric shaver according to an embodiment of the present invention, FIG. 1A being a front view thereof, FIG. 1B being a side view, and FIG. 1C being a back view.
Figure 1B:
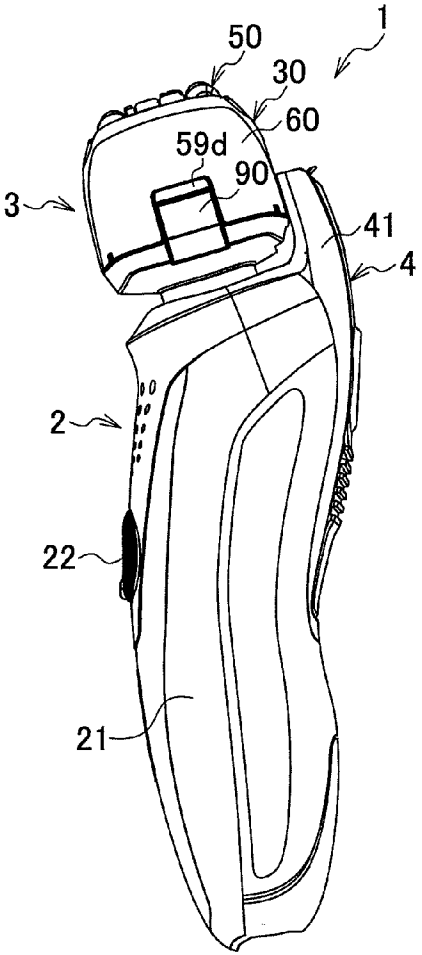
Figure 1A:
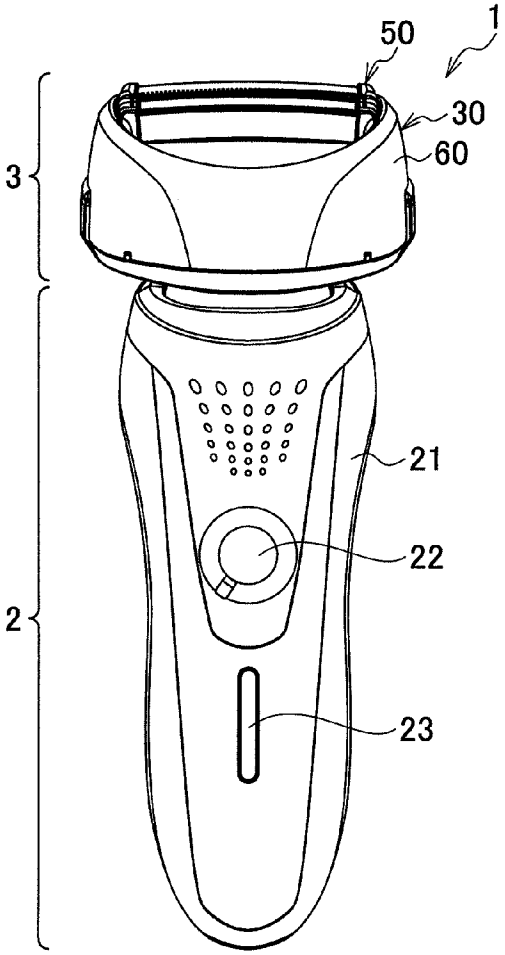

As shown in FIGS. 1A to 1C, a reciprocating electric shaver 1 according to the embodiment includes a grip section 2 gripped by a hand and a head section 3 supported by the grip section 2.

The grip section 2 includes a grip body 21 made of synthetic resin. As shown in FIG. 1A, the grip body 21 is provided with a switch portion 22 and a display portion 23. The switch portion 22 turns on and off a rotary motor 110 (see FIG. 2). The display portion 23 displays a charge state of a not-shown battery incorporated in the grip body 21. In the reciprocating electric shaver 1 according to the embodiment, a trimmer unit 4 is formed. As shown in FIG. 1C, a trimmer handle 41 is attached in the back side (rear side) of the grip body 21 so as to slide in the up-down direction. At an upper end of the trimmer handle 41, a trimmer blade 41*a* is formed.

Inner blades 54 provided within the outer blades 51 (under the outer blades 51) exposed above the head section 3 are moved relatively to the outer blades 51 (reciprocated in the right-left direction Y) to cut body hair inserted in blade holes of the outer blades in conjunction with the outer blades 51.

Hereinafter, the configuration of the head section 3 is described.

Figure 2:
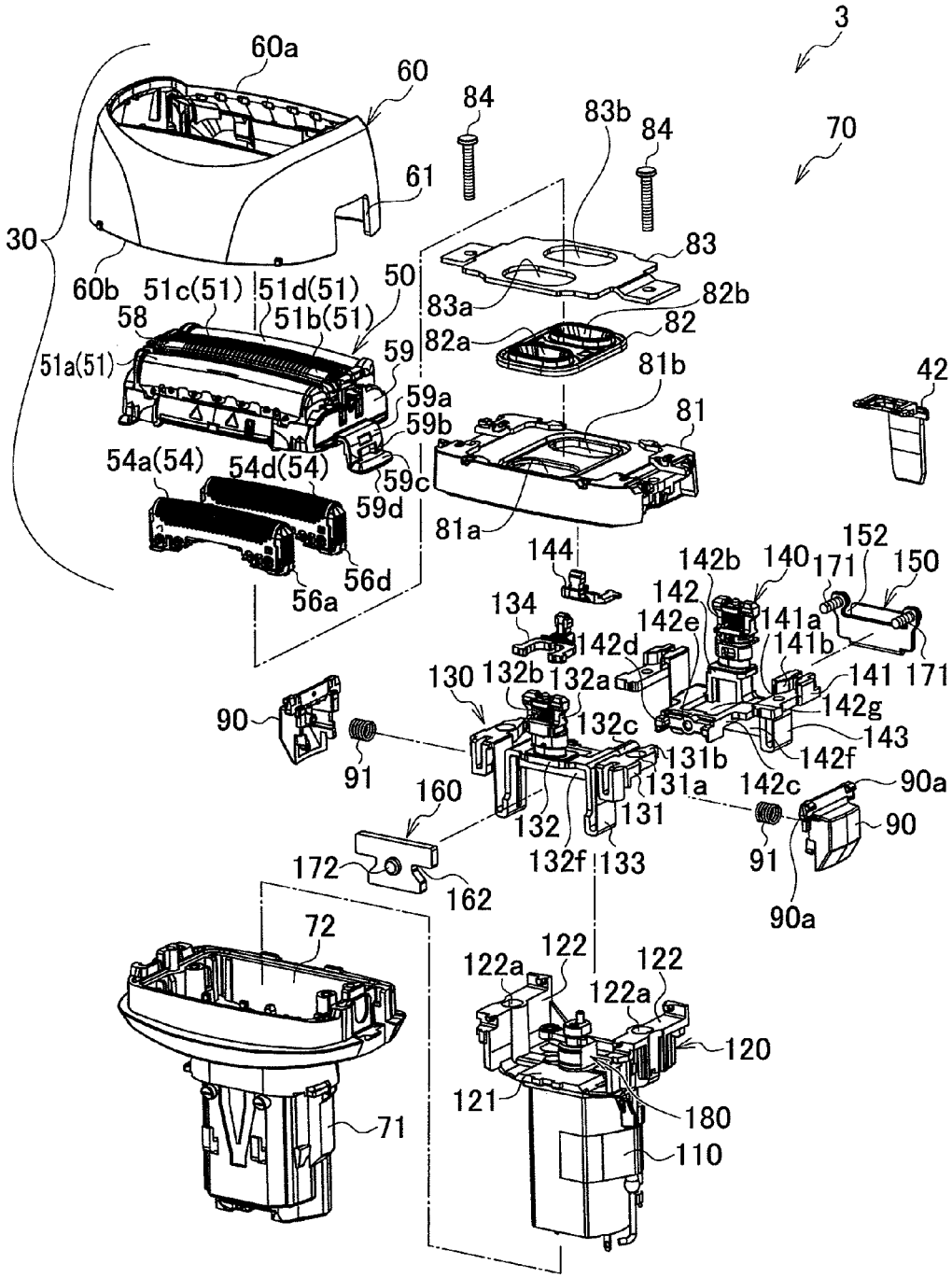
FIG. 2 is an exploded perspective view showing a head section according to the embodiment of the present invention.

As shown in FIG. 2, the head section 3 includes a head section body 70 attached to the grip body 21 and a blade flame unit 30 detachably attached to the head section body 70.

In this embodiment, a later-described driving mechanism 100 is accommodated in a driving mechanism accommodation portion 72 formed in a head case 71 opened upward. Moreover, a head case cover 81 is placed over the upper opening portion of the head case 71 with the driving mechanism 100 accommodated in the driving mechanism accommodation portion 72 and is fixed by screws 84 with a driving element water-proof rubber 82 and a rubber holding plate 83 interposed therebetween, thus forming the head section body 70.

At this time, the driving mechanism accommodation portion 72 accommodates portions of the driving mechanism 100 other than attachment portions to which the inner blades 54 are attached. In this embodiment, the attachment portions include inner blade attachment portions 132*a* and 142*a* of the first and second driving elements 130 and 140 and driving rods 134 and 144 attached to the inner blade attachment portions 132*a* and 142*a*. In other words, only the attachment portions out of the driving mechanism 100 to which the inner blades 54 are attached are exposed above the head section body 70.

To be specific, first, the head case cover 81 is put on the upper opening portion of the head case 71 in such a manner that the inner blade attachment portions 132*a* and 142*a* of the first and second driving elements 130 and 140 are respectively inserted into through-holes 81*a* and 81*b* formed in the head case cover 81 to be exposed above the head case cover 81.

Next, the inner blade attachment portions 132*a* and 142*a* exposed above are respectively inserted into through-holes 82*a* and 82*b* formed in the driving element water-proof rubber 82 to be exposed above the driving element water-proof rubber 82. At this time, neck portions of the inner blade attachment portions 132*a* and 142*a* are tightened by the driving element water-proof rubber 82 to seal internal space of the driving mechanism accommodation portion 72.

The inner blade attachment portions 132*a* and 142*a* exposed above the driving element water-proof rubber 82 are respectively inserted into the through-holes 83*a* and 83*b* formed in the rubber holding plate 83 to be exposed above the rubber holding plate 83. Simultaneously, the inner blade attachment portions 132*a* and 142*a* exposed above the rubber holding plate 83 are attached to the driving rods 134 and 144, respectively. The driving mechanism 100 is thus accommodated in the driving mechanism accommodation portion 72 in a state where the attachment portions for attachment of the inner blades 54 are exposed above the head section body 70.

As described above, in this embodiment, the head case 71, head case cover 81, driving element water-proof rubber 82, and rubber holding plate 83 constitute a substantially box-shaped water-proof space (sealed space) 80. It is therefore prevented that body hair cut by the inner blades 54 or water used to wash the inner blades 54 or the like enters in the water-proof space 80 accommodating the rotary motor 110 and the like.

As shown in FIG. 2, the blade flame unit 30 includes a box-shaped outer blade cassette 50 and a cylindrical peripheral frame 60. The outer blade cassette 50 includes a plurality of outer blades 51 which are movable in the up-down direction. The peripheral frame 60 is attached so as to accommodate the outer blade cassette 50 from below and cover the entire outer blade frame 59 of the outer blade cassette 50.

The outer blade cassette 50 includes a plurality of outer blades 51 arranged side by side in the front-back direction X. This embodiment includes four outer blades 51 including a first net blade 51*a*, a finishing net blade 51*b*, a slit blade 51*c*, a second net blade 51*d* arranged side by side in the front-back direction X (see FIG. 3).

Figure 6:
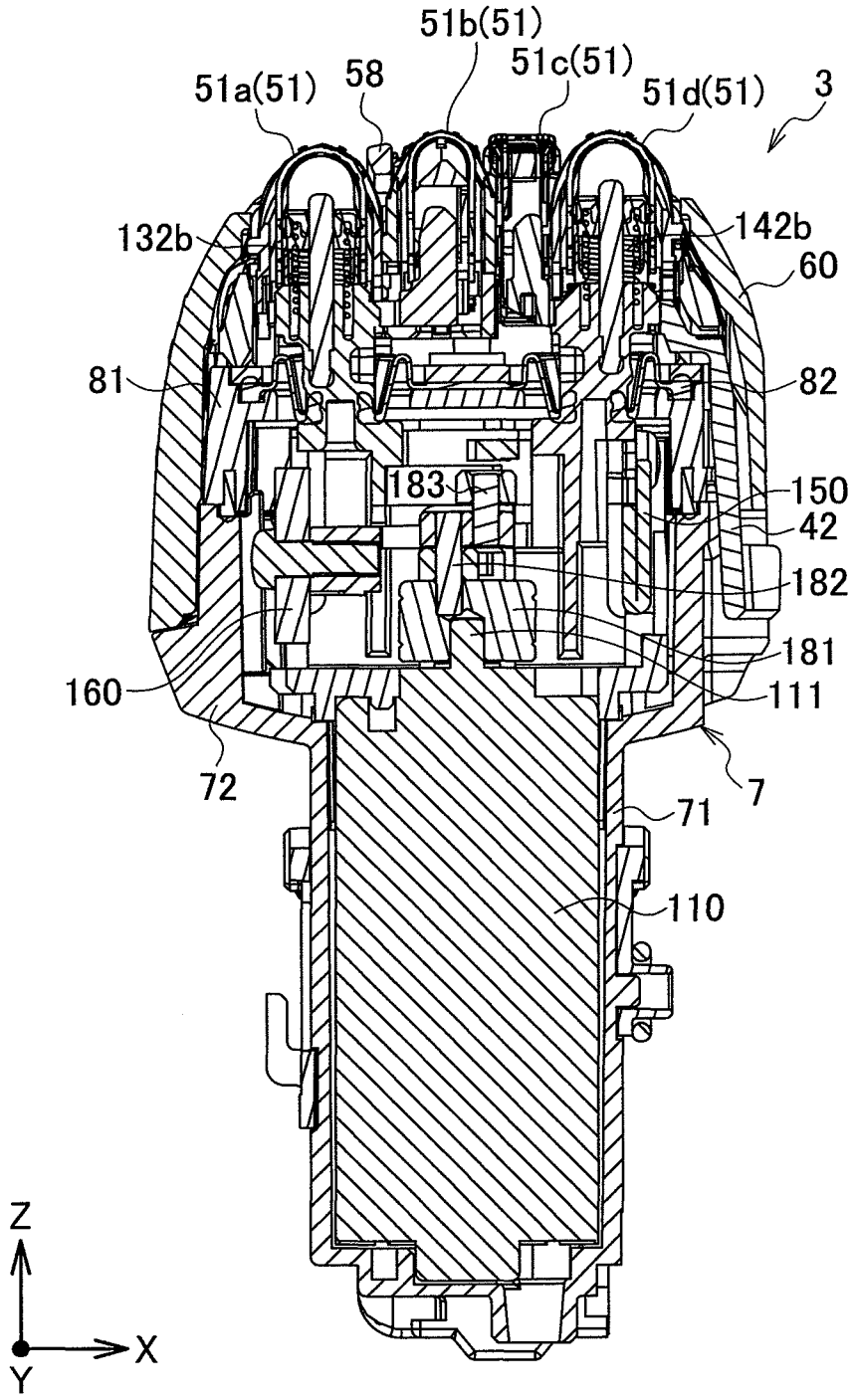
FIG. 6 is a sectional side view of the head section according to the embodiment of the present invention.
Figure 7:
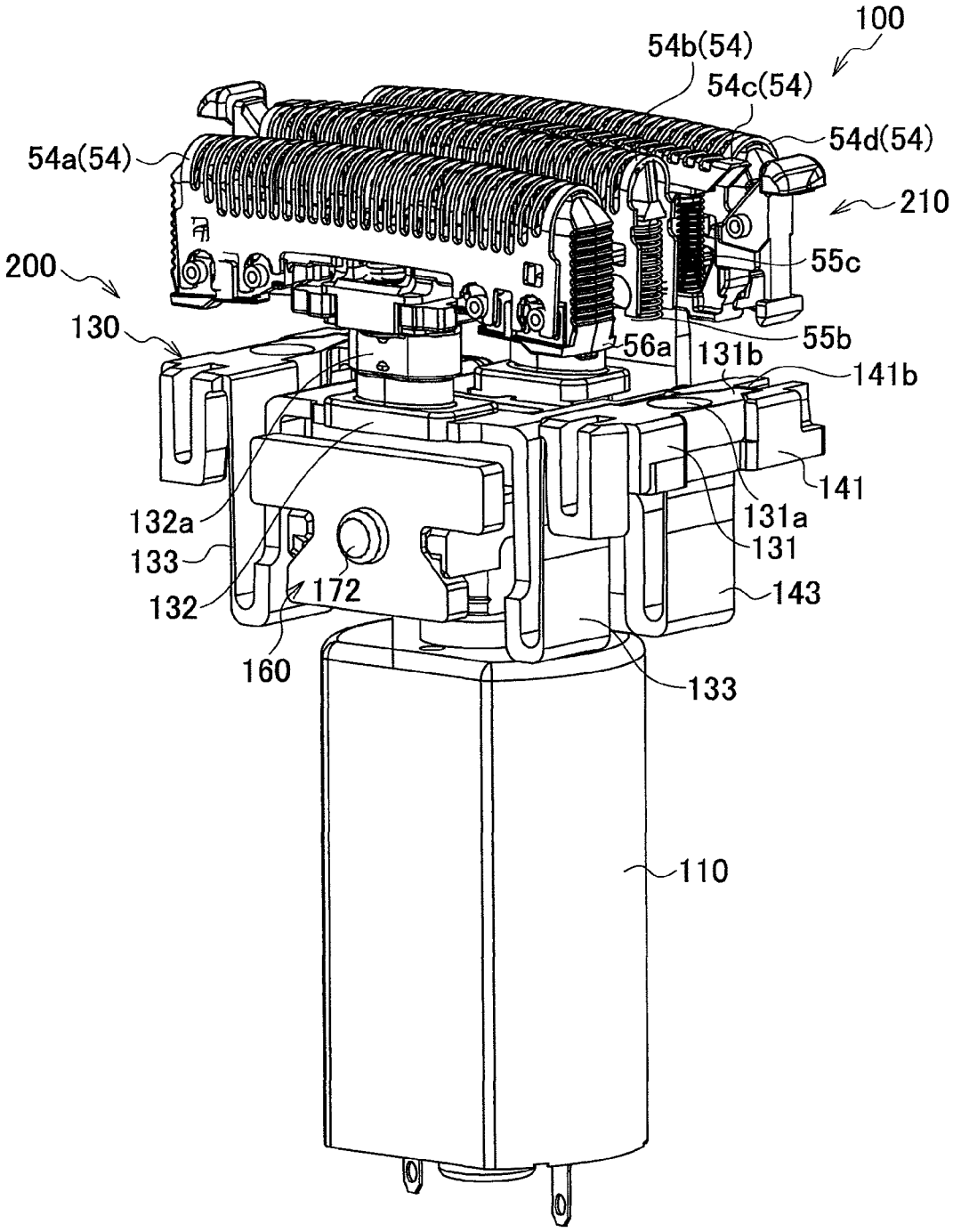
FIG. 7 is a perspective view of a driving mechanism according to the embodiment of the present invention.

As shown in FIG. 6, each of the net blades 51*a*, 51*b*, and 51*d* is curved in an inverted U-shape along the front-back direction (in the short-side direction) X so as to convex upward when viewed from the side (when the outer blades are viewed in the right-left direction Y). Furthermore, each of the net blades 51*a*, 51*b*, and 51*d* is slightly curved in the left-right direction (in the longitudinal direction) Y so as to convex upward when viewed from the front (when the outer blades are viewed in the front-back direction X). In this embodiment, the net blades 51*a*, 51*b*, and 51*d* are curved so as to convex upward when viewed from the front but do not need to be curved.

In the net blades 51*a*, 51*b*, and 51*d*, a number of blade holes (not shown) are defined. In this embodiment, as shown in FIG. 6, the blade width of the finishing net blade 51*b* (width in the front-back direction X) is made smaller than the blade widths of the first and second net blades 51*a* and 51*d*. By making the blade width of the finishing net blade 51*b* smaller than the blade widths of the other net blades 51*a* and 51*d* (widths in the front-back direction X), that is, by making the curvature radius of the finishing net blade 51*b* smaller, skin pressed against the surface is greatly protruded inside through the blade holes, so that the finishing net blade 51*b* can cut body hair shorter.

Figure 3:
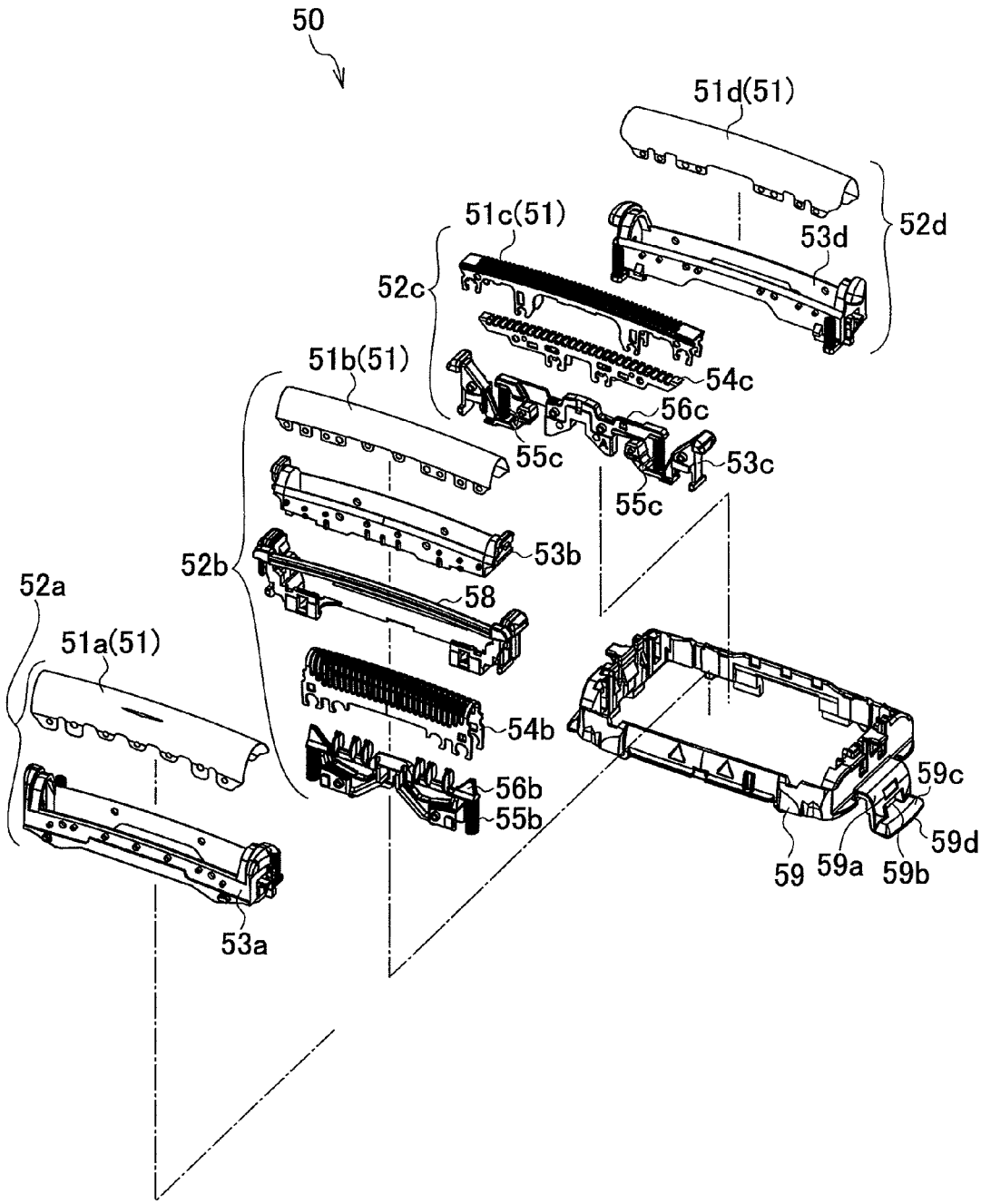
FIG. 3 is an exploded perspective view showing a blade flame section according to the embodiment of the present invention.

As shown in FIG. 3, the slit blade 51*c* is curved in a squared U shape along the front-back direction (short-side direction) X and is provided with a plurality of slits (blade holes) extended from the flat upper wall to the side walls.

In other words, in the slit blade 51*c*, the number of slits (blade holes) are defined by bars provided from the flat upper wall to the side walls and bars extending at bottoms of the side walls in the longitudinal direction (right-left direction) Y.

The net blades 51*a*, 51*b*, and 51*d* constituting the outer blades 51 are attached to specialized outer blade flames 53*a*, 53*b*, and 53*d* to form outer blade units 52*a*, 52*b*, and 52*d*, respectively.

A skin guard member 58 is attached to the first net blade 51*a* side of the outer blade frame 53*b*. The slit blade 51*c* and skin guard member 58 sandwiching the finishing net blade 51*b* at the front and rear effectively prevent skin from being strongly pressed against the finishing net blade 51*b* having a small curvature radius.

The outer blade units 52*a*, 52*b*, 52*c*, and 52*d* are independently engaged with the outer blade frame 59 so as to move up and down, thus forming the outer blade cassette 50. This outer blade cassette 50 is detachably attached to the peripheral frame 60 and is detachably attached to the head section body 70.

The inner blades 54 are dedicatedly provided corresponding to the net blades 51*a*, 51*b*, and 51*d* and slit blade 51*c* constituting the outer blades 54. Specifically, under (inside) the net blades 51*a*, 51*b*, and 51*d*, inverted U-shaped inner blades 54*a*, 54*b*, and 54*d* along the curves of the net blades 51*a*, 51*b*, and 51*d* are provided, respectively (see FIGS. 2 and 3). Under (inside) the slit blade 51*c*, an inner slit blade 54*c* having a squared U-shape along the curve of the slit blade 51*c* is provided.

These inner blades 54*a*, 54*b*, and 54*d* and inner slit blade 54*c* are attached to the driving mechanism 100 (the inner blade attachment portions 132*a* and 142*a* and driving rods 134 and 144 of the first and second driving elements 130 and 140). When the driving mechanism 100 is driven, the inner blades 54*a*, 54*b*, and 54*d* and inner slit blade 54*c* are configured to individually reciprocate in the right-left direction (longitudinal direction) Y.

The inner blades 54*a*, 54*b*, and 54*d* and inner slit blade 54*c* provided under (inside) the net blades 51*a*, 51*b*, and 51*d* and slit blade 51*c* are respectively moved relatively to the net blades 54*a*, 54*b*, and 54*d* and inner slit blade 54*c* (reciprocated in the right-left direction Y) to cut body hair inserted in the blade holes of the net blades 51*a*, 51*b*, and 51*d* and the slits of the inner slit blade 54*c* in conjunction with the net blades 51*a*, 51*b*, and 51*d* and slit blade 51*c*.

In this embodiment, the finishing inner blade 54*b* attached to a base 56*b* is attached to the outer blade cassette 50 so as to reciprocate relatively to the finishing net blade 51*b*, and the inner slit blade 54*c* attached to a base 56*c* is attached to the outer blade cassette 50 so as to reciprocate relatively to the slit blade 51*c* (see FIG. 3).

To be specific, as shown in FIG. 3, outer blade frames 53*c* to which the slit blade 51*c* is attached are provided at both ends in the direction Y, and the base 56*c* is attached between the outer blade flames 53*c* with inner blade lifting springs 55*c* interposed therebetween so as to reciprocate in the direction Y. The inner slit blade 54*c* is attached to the base 56*c*, and the slit blade 51*c* is attached to the outer blade frames 53*c* over the inner slit blade 54*c*, thus forming the outer blade unit 52*c*.

The outer blade frame 53*b* attached to the finishing net blade 51*b* is attached to the skin guard member 58, and the finishing inner blade 54*b* attached to the base 56*b* is provided under the finishing net blade 51*b* and is energized by inner blade lifting springs 55*b*, thus forming the outer blade unit 52*b* (see FIG. 3).

As described above, in this embodiment, the outer blade cassette 50 is attached to the head section body 70 with the inner blades 54*a* and 54*d* respectively attached to the inner blade attachment portions 132*a* and 142*a* exposed above the head section body 70, and the driving rods 134 and 144 are respectively attached to the inner blade attachment portions 132*a* and 142*a*. The outer blade cassette 50 is attached to the head section body 70 so that the inner blades 54*a* and 54*d* are placed under the outer blade units 52*a* and 52*d*. When the outer blade cassette 50 is attached to the head section body 70, the bases 56*b* and 56*c* attached to the outer blade cassette 50 are coupled with the driving rods 134 and 144, respectively. In other words, by attaching the outer blade cassette 50 to the head section body 70, the finishing inner blade 54*b* and inner slit blade 54*c* can be operated in conjunction with the movement of the driving mechanism 100.

Moreover, as shown in FIG. 2, elastic pieces 59*a* are extended downward at both right and left sides of the outer blade frame 59 of the outer flame cassette 50. In the paired right and left elastic pieces, through-holes 59*b* penetrating in the right-left direction are individually formed. Furthermore, at the bottoms of the elastic pieces 59*a*, release buttons 59*c* are individually extended outward.

Figure 5:
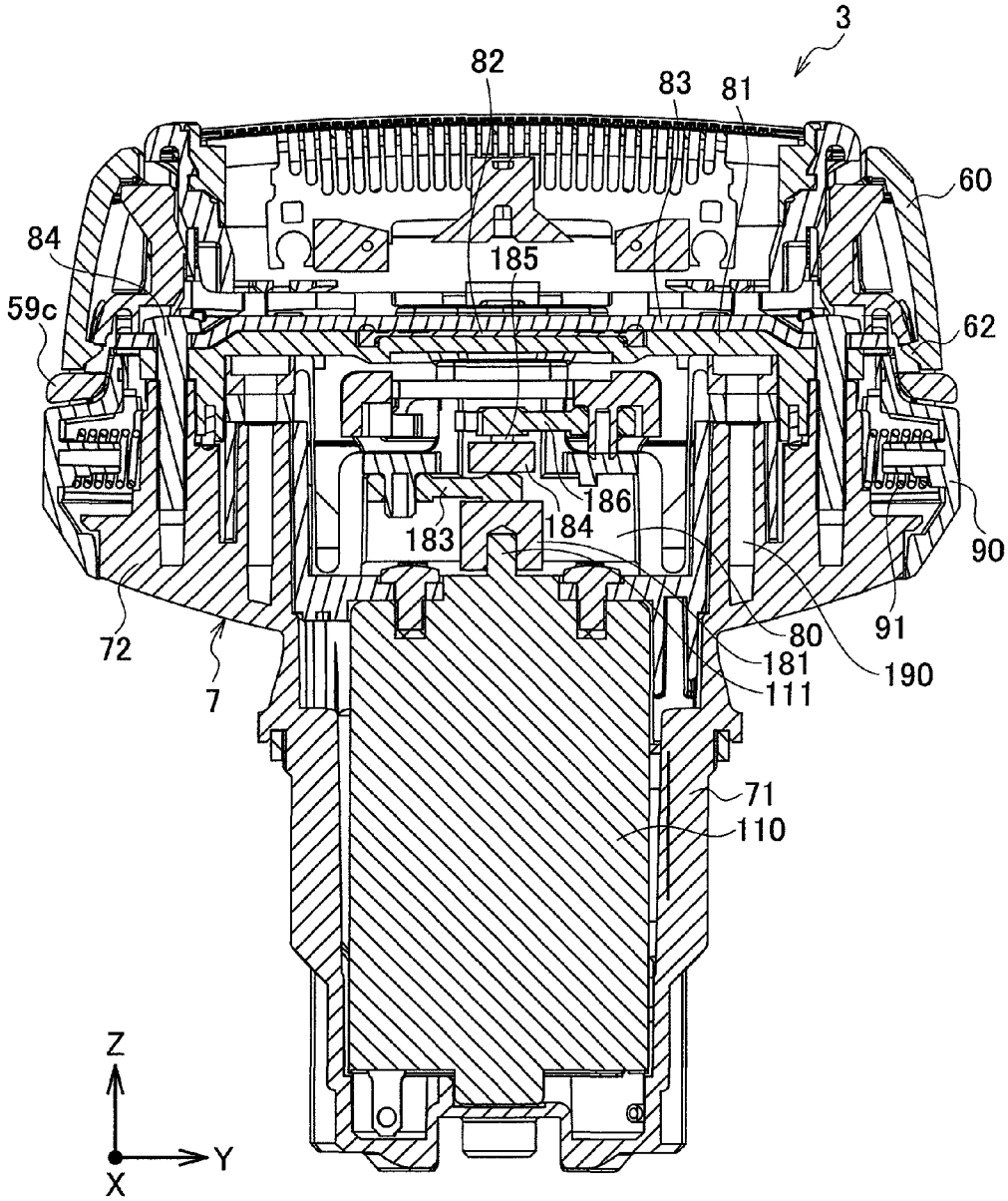
FIG. 5 is a cross-sectional view of the head section according to the embodiment of the present invention.

In the cylindrical outer frame 60 open at the top and bottom ends, recessed portions 61 are formed at both right and left sides of the bottom edge, and hooks 62 are individually protruded inward from the bottoms of the recessed portions 61 (see FIG. 5).

In this embodiment, in the outer frame 60, a top opening 60*a* is smaller than the profile of the outer blade frame 59 of the outer blade cassette 50 and larger than the profile of the entire blade faces of the outer blades 51. A lower opening 60*b* is larger than the profile of the outer blade frame 59 other than the release buttons 59*c*.

As the outer blade cassette 50 is inserted from the lower opening 60*b* into the outer frame 60 with the release buttons 59*c* at the both right and left ends being inserted into the recessed portions 61, the top ends of the hooks 62 protruded inward from the outer frame 60 are externally engaged with the through holes 59*b* of the both elastic pieces 59*a* of the outer blade frame 59 (see FIG. 5). The outer blade frame 59, or the outer frame cassette 50 is thus attached to the outer frame 60.

Figure 4:
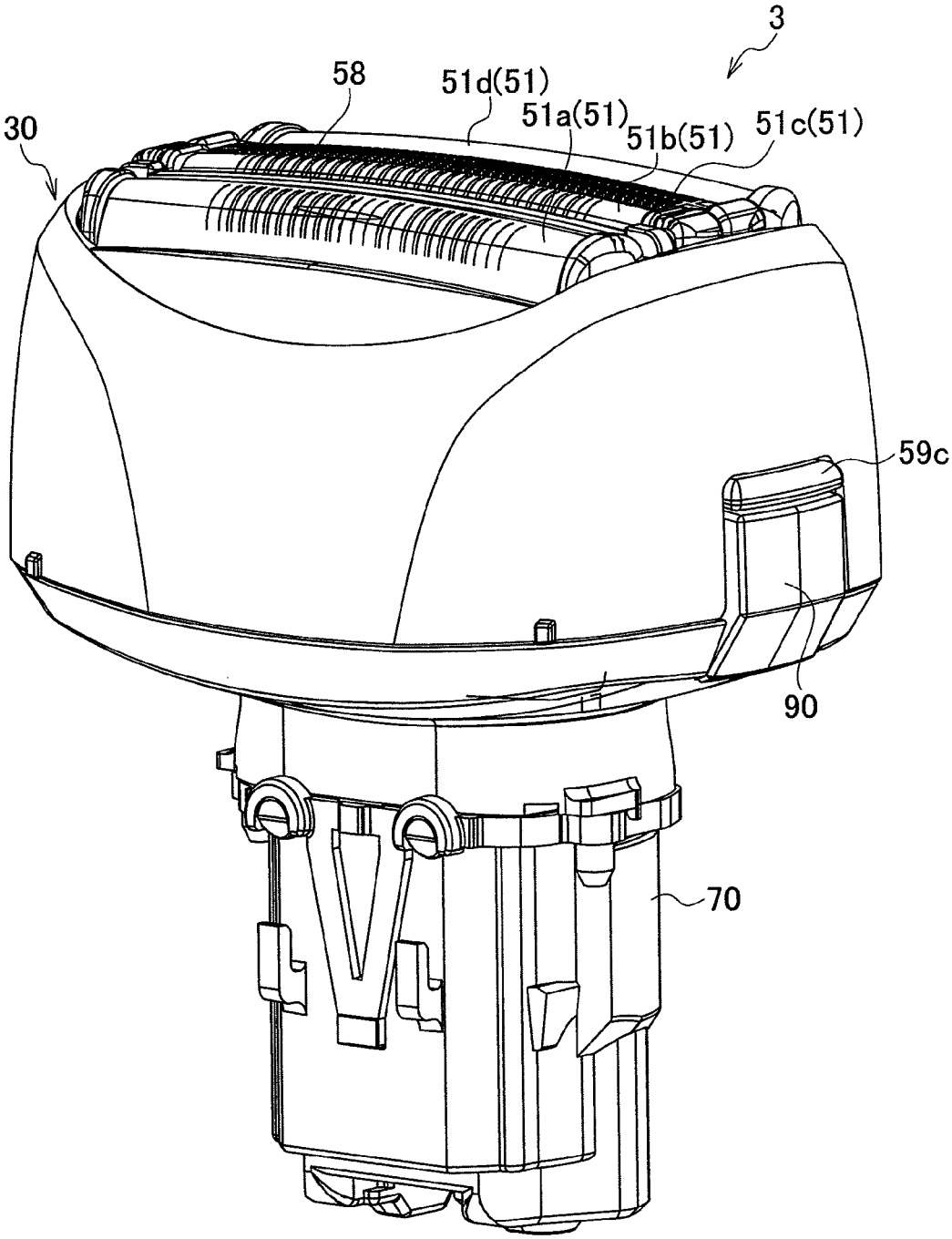
FIG. 4 is a perspective view of the head section according to the embodiment of the present invention.

As shown in FIGS. 4 and 5, the release buttons 59*c* of the outer blade frame 59 are provided so that the top ends thereof protrude outward from the respective outer side surfaces of the outer frame 60 when the outer frame 60 is attached. Accordingly, if operation faces 59*d* at the top ends of the right and left release buttons 59*c* are grasped and sandwiched to be depressed inside, the elastic pieces 59*a* at both sides bend inward to release the engagement of the hooks 62 and through-holes 59*b*, and the outer blade cassette 50 is thus detached from the outer frame 60.

As shown in FIG. 5, at both right and left ends of the head section body 70, release buttons 90 are provided so as to protrude and retract while being energized outward in the right-left direction Y. At both ends of the top part of each release button 90 in the width direction (front-back direction X), engagement protrusions 90*a* are provided (see FIG. 2).

If the blade frame unit 30 is placed over the head section body 70 while the release buttons 90 are inserted through the recessed portions 61 of the outer frame 60 at the both right and left ends, the engagement protrusions 90*a* energized outward in the right-left direction Y are engaged with not-shown engagement recesses formed in the inner periphery of the outer blade frame 59. The outer blade frame 90 (the outer blade cassette 50 or the entire blade flame unit 30) is thus attached to the upper end of the head section body 70.

If the release buttons 90 are depressed inside against the energization force of the springs 91, the engagement of the engagement protrusions 90*a* and engagement recesses (not shown) is released, and the outer blade frame 59 is then detached from the head section body 70.

Next, the driving mechanism 100 is described.

In this embodiment, as shown in FIG. 2, the driving mechanism 100 includes: a rotary motor 110; a support 120 supporting the rotary motor 110; the first and second driving elements 130 and 140 which are supported on the support 120 and reciprocate in opposite phases; and a conversion mechanism 180 converting rotating motion of the rotary motor 110 to reciprocating motion and transmitting the reciprocating motion to the first and second driving elements 130 and 140.

The rotary motor 110 is attached to the support 120 so as to hang downward. The support 120 includes: a bottom wall 121; and fixed side walls 122 integrally stood from right and left edges of the bottom wall 121. In each fixed side wall 122, a threaded hole 122*a* is formed. Fixing screws 190 are screwed into the treaded holes 122*a* to fix the support 120 to the head case 71 together with the first and second driving elements 130 and 140.

The conversion mechanism 180 includes: a base 181 rotatably attached to a rotating shaft 111 of the rotary motor 110 protruded from the bottom wall 121 of the support 120; and a lower eccentric shaft 182 provided eccentrically away from the rotating shaft 111. The conversion mechanism 180 further includes: a lower coupling arm 183 which is attached to the lower eccentric shaft 182 and couples the lower eccentric shaft 182 and the second driving element 140; and a base 184 attached to the lower eccentric shaft 182. The conversion mechanism 180 further includes: an upper eccentric shaft 185 provided for the base 184 eccentrically away from the rotating shaft 111; and an upper coupling arm 186 which is attached to the upper eccentric shaft 185 and couples the upper eccentric shaft 185 and the first driving element 130.

In this embodiment, the upper and lower eccentric shafts 182 and 185 are provided with a phase difference of 180 degrees around the rotating shaft 111 of the rotary motor 110 and converts rotating motion of the rotary motor 110 to reciprocating motion of the first and second driving elements 130 and 140 in opposite phases.

Figure 12:
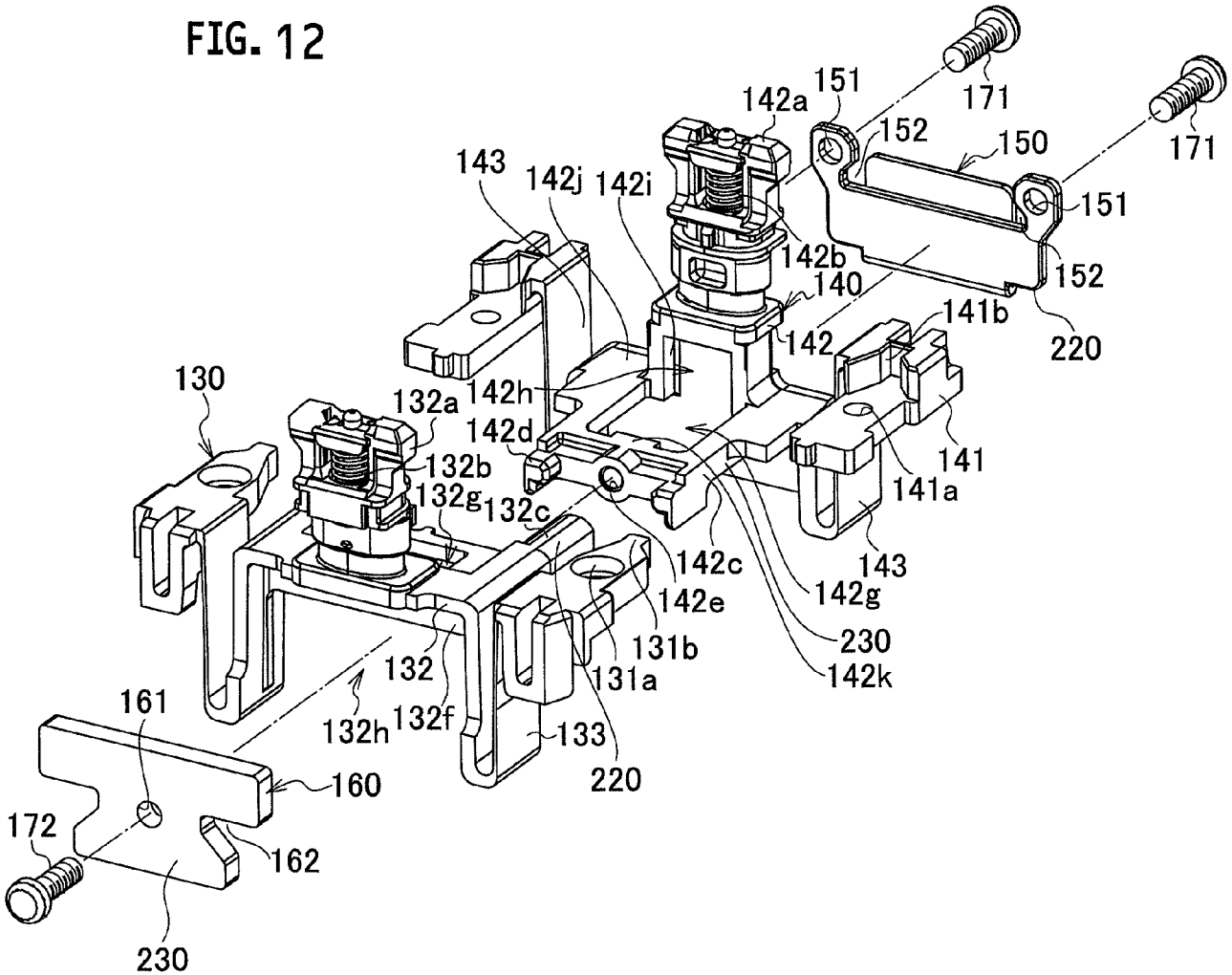
FIG. 12 is an exploded perspective view showing driving elements and balance adjustment members according to the embodiment of the present invention.
Figure 13:
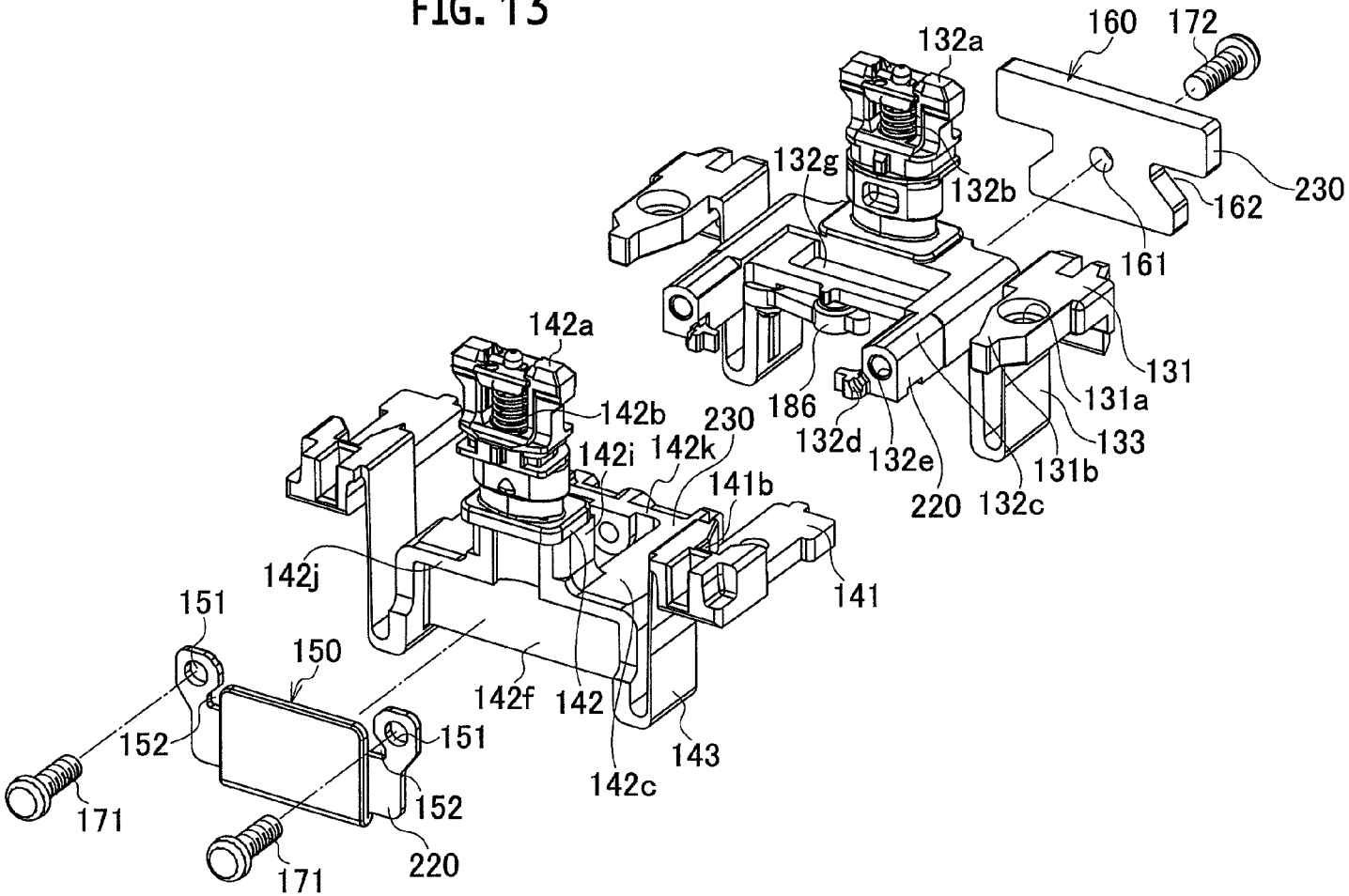
FIG. 13 is an exploded perspective view of the driving elements and balance adjustment members according to the embodiment of the present invention when viewed in a direction opposite to FIG. 12.
Figure 14A:
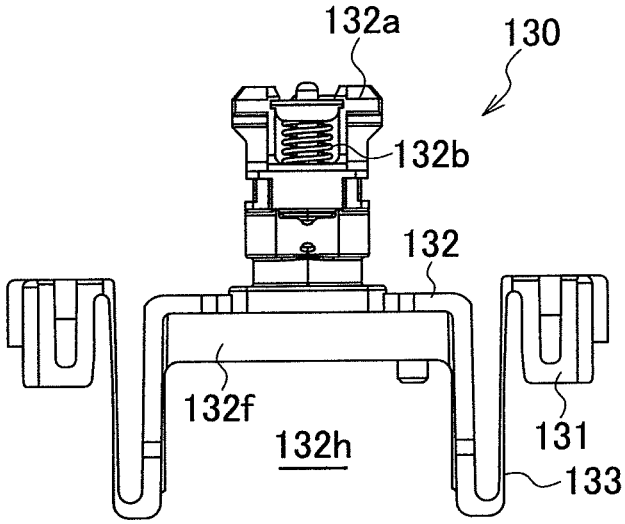
FIGS. 14A and 14B are front and plan views, respectively, showing a first driving element according to the embodiment of the present invention.
Figure 14B:
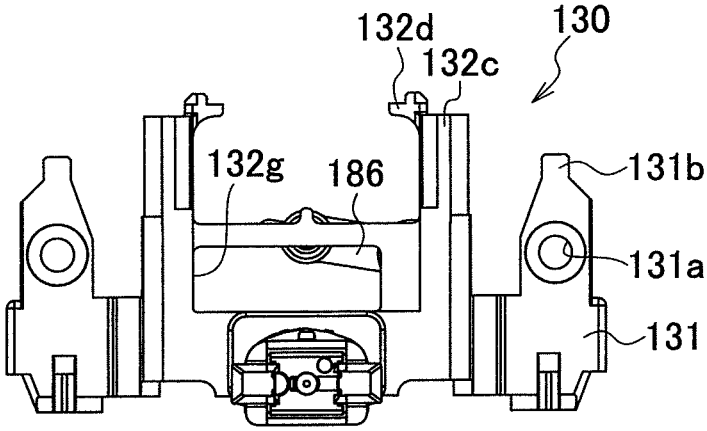
Figure 15A:
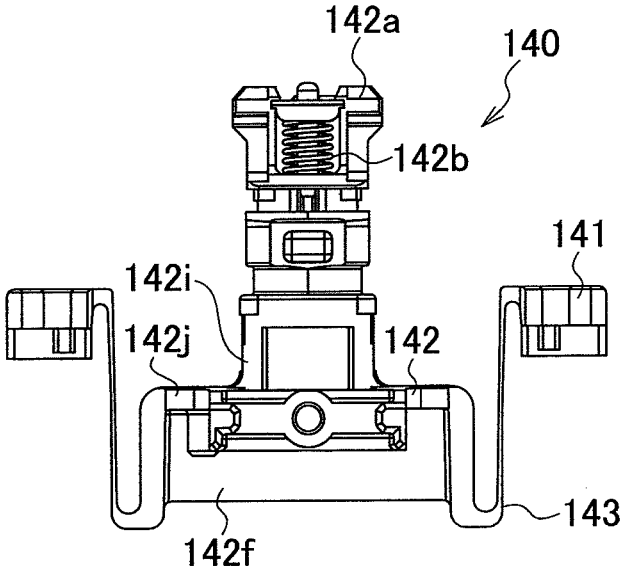
FIGS. 15A and 15B are front and plan views, respectively, showing a second driving element according to the embodiment of the present invention.
Figure 15B:
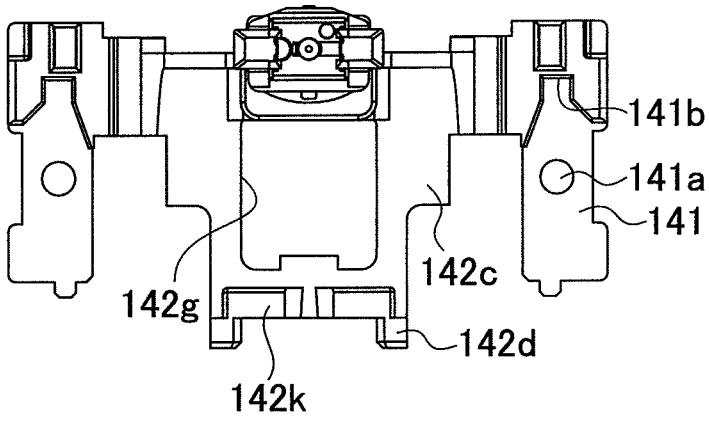

As described above, the first and second driving elements 130 and 140 include the inner blade attachment portions 132*a* and 142*a* to which the inner blades 54*a* and 54*d* are detachably attached, respectively. As shown in FIGS. 12 and 13, the first driving element 130 is formed by connecting fixing blocks 131, which are arranged at both ends in the width direction, to the support frame 132, which supports the inner blade attachment portion 132*a*, with a pair of elastically deformable elastic legs (elastic legs supporting the inner blade attachment portions 132*a* so as to reciprocate) 133. The second driving element 140 is formed by connecting fixing portions 141, which are arranged at both ends in the width direction, to the support frame 142, which supports the inner blade attachment portion 142*a*, with a pair of elastically deformable elastic legs (elastic legs supporting the inner blade attachment portions 142*a* so as to reciprocate) 143. The elastic legs 133 and 143 are arranged under the inner blade attachment portions 132*a* and 142*a*, respectively, when viewed in the right-left direction (the direction of reciprocation of the driving elements) Y (see FIG. 9).

The fixing blocks 131 and 141 are respectively provided with threaded holes 131*a* and 141*a* and engagement portions engaged with each other (engagement protrusions 131*b* and 141*b* in this embodiment). When the fixing block 131 is placed on the fixing block 141 with the engagement protrusions 131*b* and 141*b* engaged with each other, the threaded holes 131*a* and 141*a* communicate with each other. The screws 190 are inserted into the threaded holes 131*a* and 141*a* communicating with each other to fix the first and second driving elements 130 and 140 to the head case 71 with the support 120 interposed therebetween.

The support frames 132 and 142 each have a rectangular plate shape substantially horizontally extending, and on the support frames 132 and 142, the inner blade attachment portions 132*a* and 142*a* are protruded, respectively. At both ends of the support frame 142 in the width direction, side walls 142*i* are extended downward, and at the lower end of each side wall 142*i*, a horizontal wall 142*j* is extended outward in the width direction (see FIG. 12).

Each of the elastic legs 133 has a folded sheet-like shape. An end thereof is connected to the upper inner end of the corresponding fixing block 131, and the other end is connected to one of the outer ends of the support frame 132. On the other hand, each of the elastic legs 143 has a folded sheet-like shape. An end thereof is connected to the upper inner end of the corresponding fixing block 141, and the other end is connected to one of the outer ends of the horizontal wall 142*j*. In other words, the elastic leg 143 connects the fixing block 141 and the support frame 142 with the horizontal wall 142*j* and side wall 142*i* interposed therebetween.

The inner blade attachment portions 132*a* and 142*a* are provided with lifting springs (energizing members) 132*b* and 142*b*, respectively. The lifting springs 132*b* and 142*b* press (energize) up the inner blades 54*a* and 54*d* attached to the inner blade attachment portions 132*a* and 142*a* (in the direction of attachment or detachment of the inner blades), respectively.

In this embodiment, the outer part of each of the elastic legs 133 and 143 is thinner than the inner part thereof. By making the outer parts of the elastic legs 133 and 143 thinner, the support frames 132 and 142 (including the inner blade attachment portions 132*a* and 142*a* and the inner blades 54) can be easily swung in the right-left direction Y. Moreover, by making thick the inner parts which are subject to reaction force from the inner blades 54*a* and 54*d* energized upward, it can be prevented that the first and second driving elements 130 and 140 are deformed by the reaction force due to the inner blades 54*a* and 54*d*.

Figure 16:
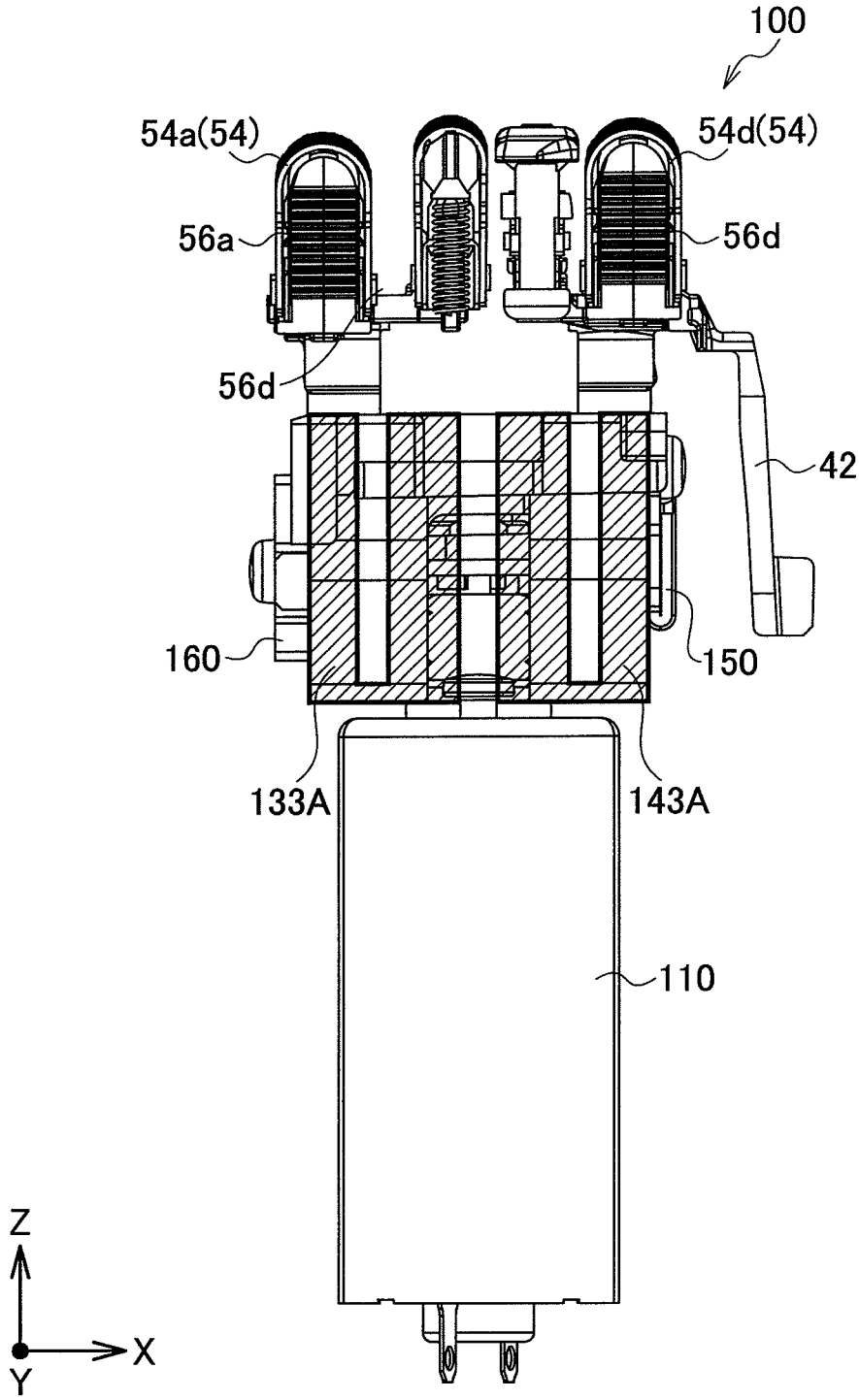
FIG. 16 is a side view showing a driving mechanism according to a first modification of the embodiment of the present invention.
Figure 17:
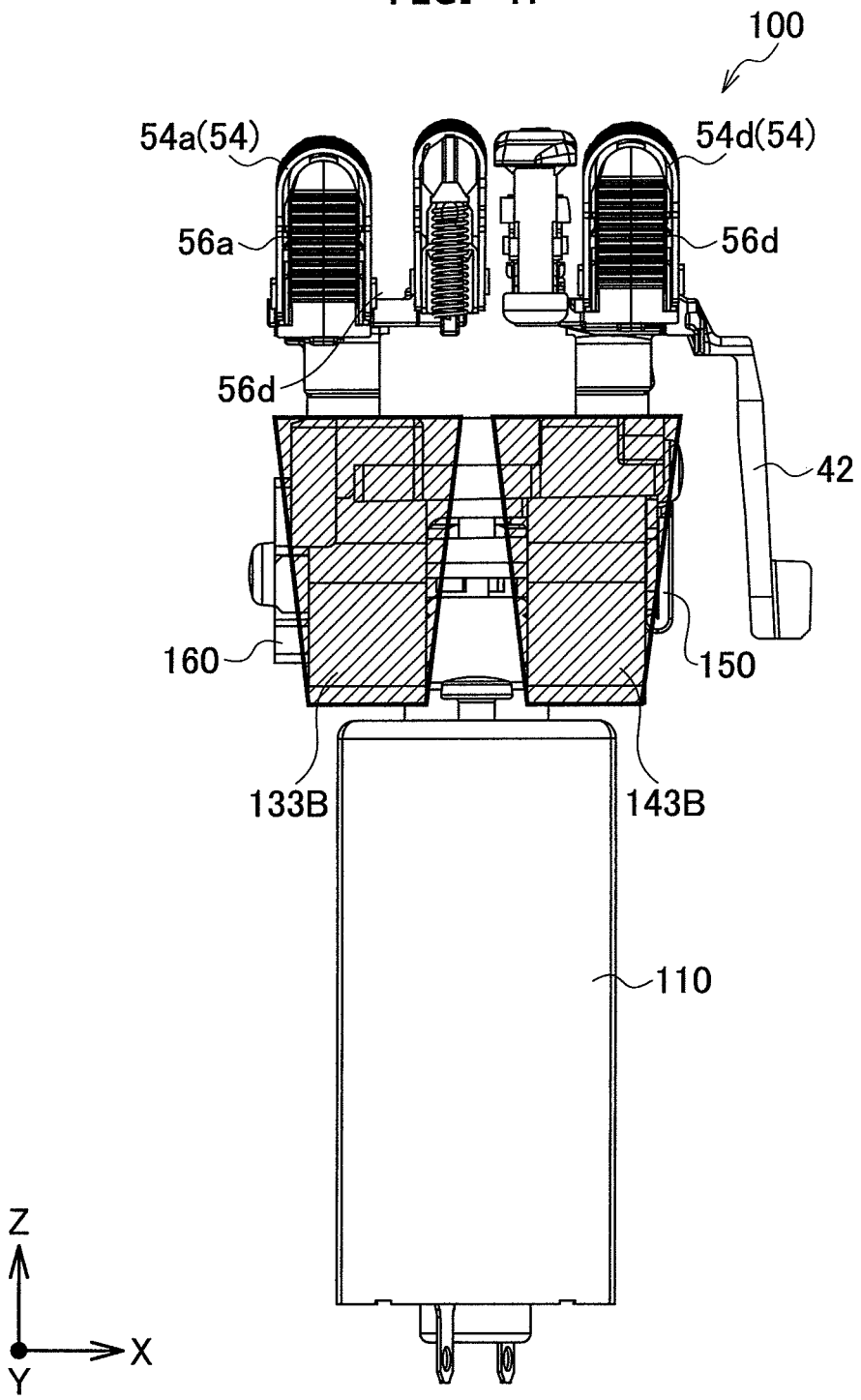
FIG. 17 is a side view showing a driving mechanism according to a second modification of the embodiment of the present invention.

The elastic legs 133 and 143 can be formed as shown in FIGS. 16 and 17. Specifically, as shown in FIG. 16, a plurality of elastic plates are arranged side by side in the front-back direction X to form each elastic leg 133A or 143A. At this time, if the elastic plates are not provided for portions less influenced by rotational moment in the front-back direction X, the elastic legs 133A and 143A can be easily deformed while the elastic legs 133A and 143A are increased in width to increase in rigidity. In other words, the support frames 132 and 142 can be easily reciprocated.

As shown in FIG. 17, each of elastic legs 133B and 143B may be configured to have a tapered profile with the top (the inner blade side) wider than the bottom. This can increase the rigidity of the upper part more likely to be influenced by the rotational moment in the front-back direction X while preventing the elastic legs 133A and 143A from becoming hard to deform as much as possible.

Figure 8:
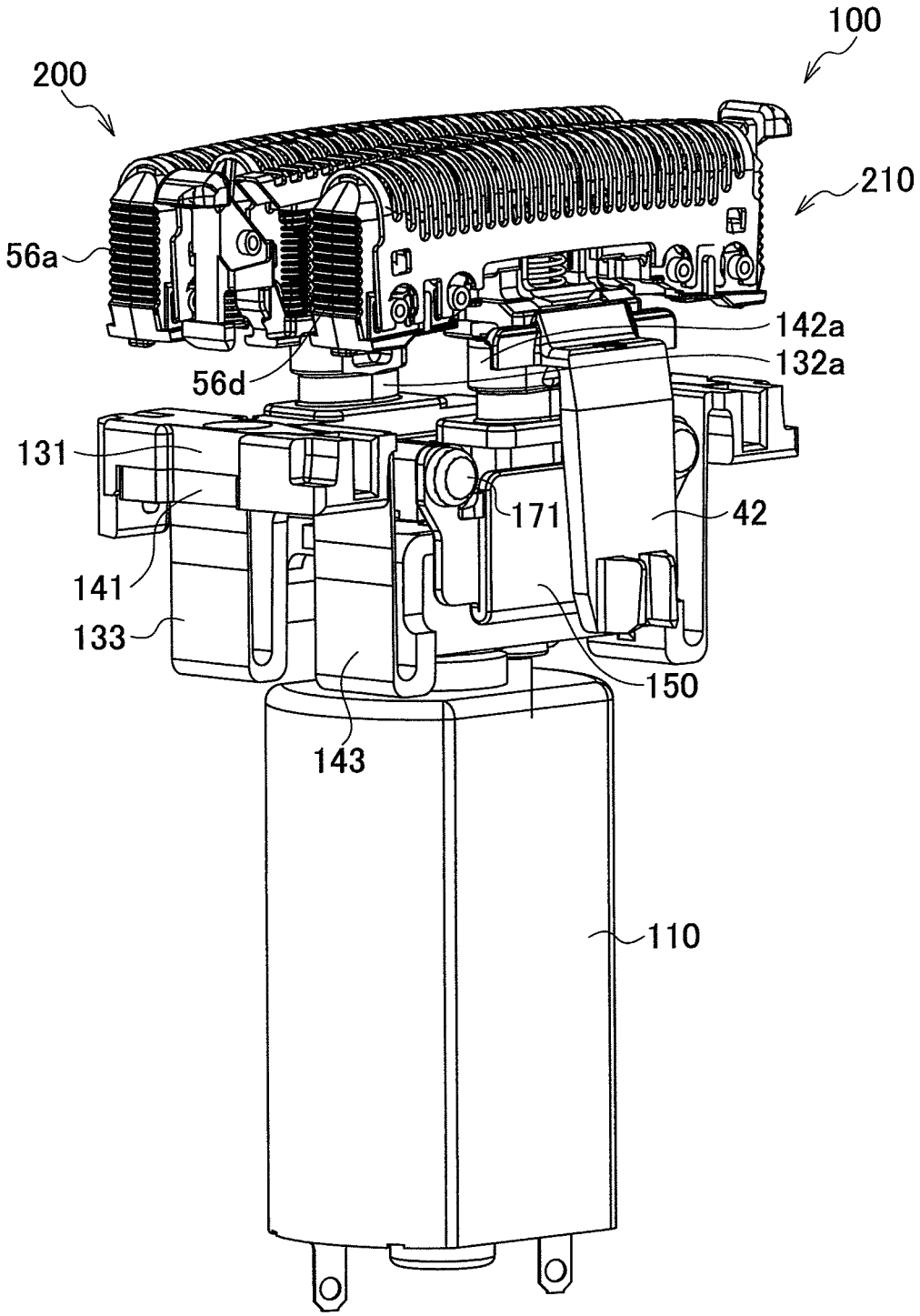
FIG. 8 is a perspective view of the driving mechanism according to the embodiment of the present invention when viewed in a direction opposite to that of FIG. 7.

Furthermore, in this embodiment, a driving rod 42 driving the trimmer blade 41*a* (see FIGS. 8 and 9) is attached to the inner blade attachment portion 142*a*. As descried above, the inner blade attachment portions 132*a* and 142*a* are coupled with the driving rods 134 and 144, respectively.

The first driving element 130 reciprocates the inner blade 54*a* and the finishing inner blade 54*b* attached to the driving rod 134 together, and the second driving element 140 reciprocates the inner blade 54*a*, the inner slit blade 54*c* attached to the driving rod 144, and the driving rod 42 together.

In this embodiment, the inner blade (including the base 56*a*) 54*a*, driving rod 134, finishing inner blade (including the base 56*b*) 54*b*, and a later-described balance adjuster 150 serve as a coupling member which is coupled with the first driving element 130 to operate in conjunction with the first driving element 130 reciprocating. The coupling member and first driving element 130 constitute a first driving block 200.

On the other hand, the inner blade (including the base 56*d*) 54*d*, inner slit blade (including the base 56*c*) 54*c*, driving rod 144, driving rod 42, and a later-described balance adjuster 160 serve as a coupling member which is coupled with the second driving element 140 to work in conjunction with the second driving element 140 reciprocating. The coupling member and second driving element 140 constitute a second driving block 210.

In this embodiment, the inner blades 54 are arranged two by two at the front and rear sides of a rotation axis C of the rotary motor 110, and the front two inner blades are reciprocated in the phase opposite to the rear two inner blades. By reciprocating the first and second driving elements 130 and 140 in opposite phases in such a manner, vibration due to inertia force in the direction of reciprocation (moment produced about the X axis) is reduced.

Figure 11A:
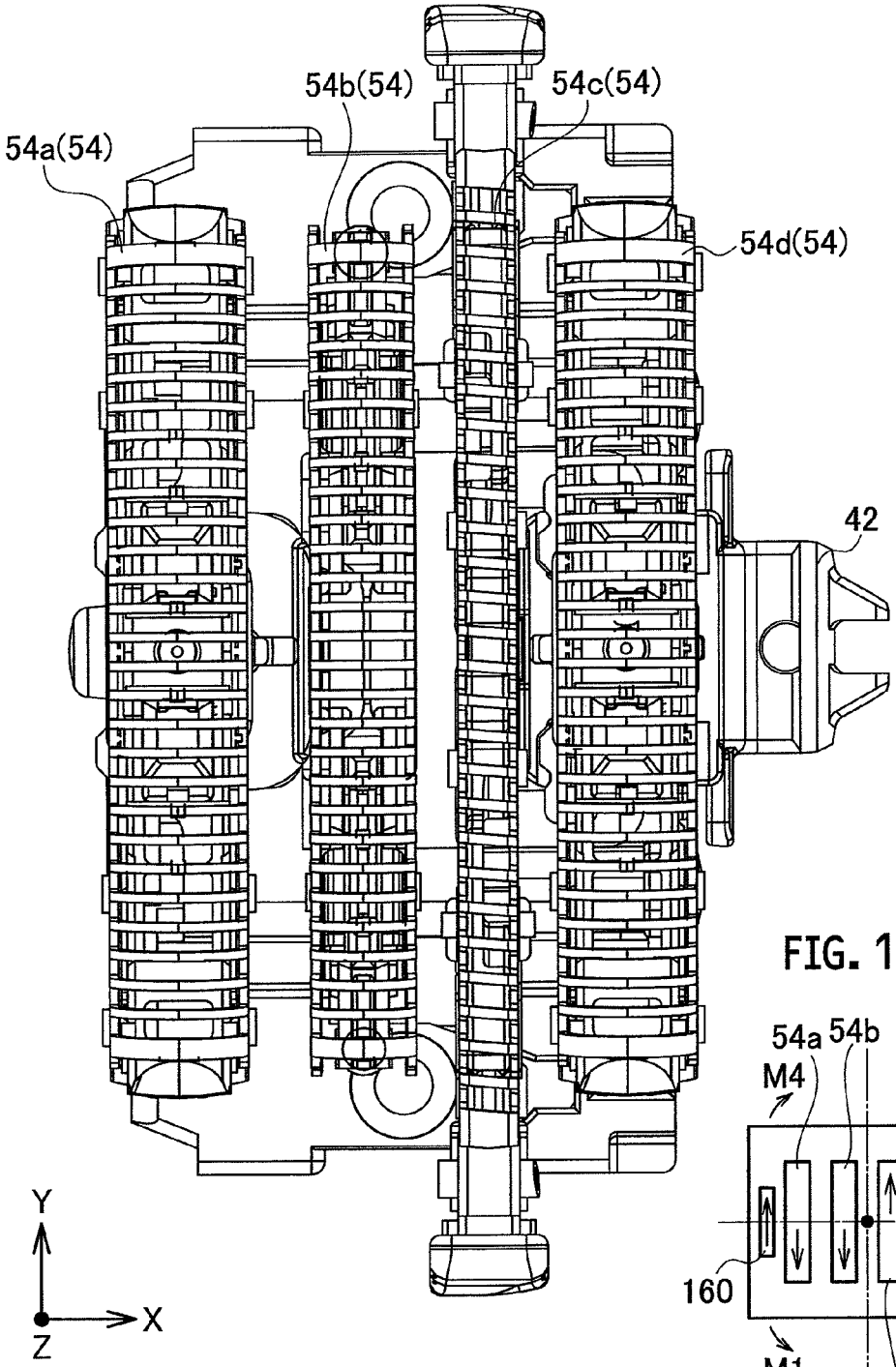
FIGS. 11A and 11B show the driving mechanism according to the embodiment of the present invention, FIG. 11A being a plan view thereof, FIG. 11B being a plan view schematically showing movement thereof during vibration.
Figure 11B:
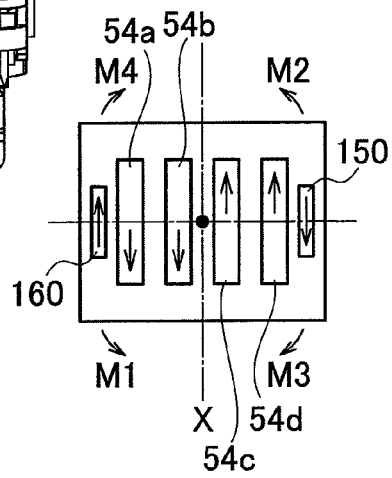

Such reciprocating motions in opposite phases can reduce the moment about the X axis but produces moments (M1 and M2 in FIG. 11B) about the rotation axis C of the rotary motor 110 in the same direction (clockwise in FIG. 11B).

Accordingly, in this embodiment, the first and second driving blocks 200 and 210 are configured to include balance adjustment portions 220 and 230 placed on the opposite sides of the rotation axis C of the rotary motor 110 from the first and second driving elements 130 and 140, respectively.

Specifically, the balance adjusters 150 and 160 are attached to the first and second driving elements 130 and 140 with holding arms 132*c* and 142*c* interposed therebetween, respectively.

By attaching the balance adjusters 150 and 160 to the first and second driving elements 130 and 140 as described above, gravity centers G1 and G2 of the first and second driving blocks 200 and 201 can be set closer to the rotation axis C of the rotary motor 110 than in the absence of the balance adjusters 150 and 160, thus reducing vibration about the rotation axis C. Furthermore, when the first and second driving blocks 200 and 210 are reciprocated in opposite phases in the state where the balance adjusters 150 and 160 are attached to the first and second driving elements 130 and 140, moments about the rotation axis C are produced at the first and second driving elements 130 and 140 so as to be opposite to the moments M1 and M2 (M3 and M4 in FIG. 11B), respectively. In short, the moments M1 and M3 are canceled out, and the moments M2 and M4 are canceled out. Accordingly, the vibration about the rotation axis C can be reduced.

The balance adjusters 150 and 160 are formed separately from the first and second driving elements 130 and 140, respectively.

In this embodiment, the balance adjustment portions 220 and 230 are provided so that the gravity centers G1 and G2 of the first and second driving blocks 200 and 210 are located between the elastic legs 133 and 143 (in a range indicated by d3 in FIG. 9) when viewed in the right-left direction (in the direction of reciprocation of the driving elements) Y.

In such a manner, the gravity centers G1 and G2 of the first and second driving blocks 200 and 201 can be therefore set closer to the rotation axis C of the rotary motor 110. This can reduce the moment to be produced about the rotation axis C of the rotary motor 110 at driving, thus reducing the vibration.

If the first and second driving blocks 200 and 210 are designed in particular so that the gravity centers G1 and G2 thereof correspond to the rotation axis C of the rotary motor 110, respectively, the moment about the rotation axis C of the rotary motor 110 can be made zero, and the occurrence of vibration can be further reduced.

In this embodiment, the balance adjuster 150 is attached to holding arms (arm portions) 132*c* which are horizontally extended from both ends of the support frame 132 in the width direction (right-left direction Y) toward the opposed second driving element 140 (backward in the front-back direction).

On the other hand, the balance adjuster 160 is attached to holding arms (arm portions) 142*c* which are horizontally extended from both ends of the horizontal wall 142*j* of the support frame 142 in the width direction (right-left direction Y) toward the opposed first driving element 130 (forward in the front-back direction).

In such a manner, the holding arms (arm portions) 132*c* extended from the first driving element 130 and the holding arms (arm portions) 142*c* extended from the second driving element 140 are located at different positions in the up-down direction Z (direction orthogonal to the direction X that the first and second driving elements 130 and 140 are arranged and the direction Y of reciprocation thereof). In this embodiment, the holding arms (arm portions) 132*c* and 142*c* are extended in the front-back direction X at different heights in the up-down direction. By arranging the holding arms (holding portions) 132*c* and 142*c* at different heights in the up-down direction in such a manner, the first and second driving blocks 200 and 210 are miniaturized.

In this embodiment, furthermore, the holding arms (arm portions) 142*c* out of the holding arms (arm portions) 132*c* and 142*c* are configured to sit above the conversion mechanism 180 in the up-down direction Z. By allowing at least one of the pair of holding arms (arms portions) 132*c* and the pair of holding arms 142*c* to sit above the conversion mechanism 180 in the up-down direction Z in such a manner, the first and second driving blocks 200 and 210 can be further miniaturized (in the height direction).

The holding arms (arm portions) 132*c* and the holding arms (arm portions) 142*c* serve as the balance adjustment portions 220 and 230 by themselves, respectively. In this embodiment, the balance adjustment portions 220 and 230 include the holding arms 132*c* and 142*c* extending from the first and second driving elements 130 and 140 toward the opposite sides across the rotation axis C of the rotary motor 110 from the first and second driving elements 130 and 140, respectively.

Accordingly, if the first and second driving elements 130 and 140 are not provided with the balance adjusters 150 and 160 but provided with the holding arms 132*c* and 142*c*, respectively, the gravity centers G1 and G2 of the first and second driving blocks 200 and 210 can be set closer to the rotation axis C of the rotary motor 110 than in the absence of the balance adjustment portions 220 and 230. In other words, the occurrence of vibration can be reduced even without the balance adjusters 150 and 160 by properly setting the lengths and weights of the holding arms 132*c* and 142*c*.

At the end faces of the holding arms 132*c* of the first driving element 130, threaded holes 132*e* are formed, and in the balance adjuster 150, attachment holes 151 are formed at the positions corresponding to the threaded holes 132*e*. The threaded holes 132*e* of the first driving element 130 are caused to communicate with the attachment holes of the balance adjuster 150, and screws 171 are then screwed into the threaded holes 132*e* of the first driving element 130, thus fixing the balance adjuster 150 to the first driving element 130. In short, the balance adjuster 150 is attached to the first driving element 130 from the front in the arrangement direction X of the first and second driving elements 130 and 140.

At the front end of the holding arm 142*c* of the second driving element 140, a connecting arm 142*k* connecting the holding arms 142 is provided to extend in the right-left direction Y. At the center of the coupling arm 142*k* in the width direction, a threaded hole 142*e* is provided. At the position corresponding to the threaded hole 142*e* in the balance adjuster 160, an attachment hole 161 is formed. The threaded hole 142*e* of the second driving element 140 is caused to communicate with the attachment hole 161, and a screw 172 is then screwed into the threaded hole 142*e*, thus fixing and retaining the balance adjuster 160 onto the second driving element 140.

Since the balance adjuster 160 is attached to the second driving element 140 from behind the first driving element 130 (from the front side in the front-back direction X) and the balance adjuster 150 is attached to the first driving element 130 from behind the second driving element 140 (from the rear in the front-back direction X), the balance adjusters 150 and 160 can be attached after the first and second driving elements 130 and 140 and the rotary motor 110 are assembled. Accordingly, this can facilitate the attachment of the balance adjusters 150 and 160.

Figure 9:
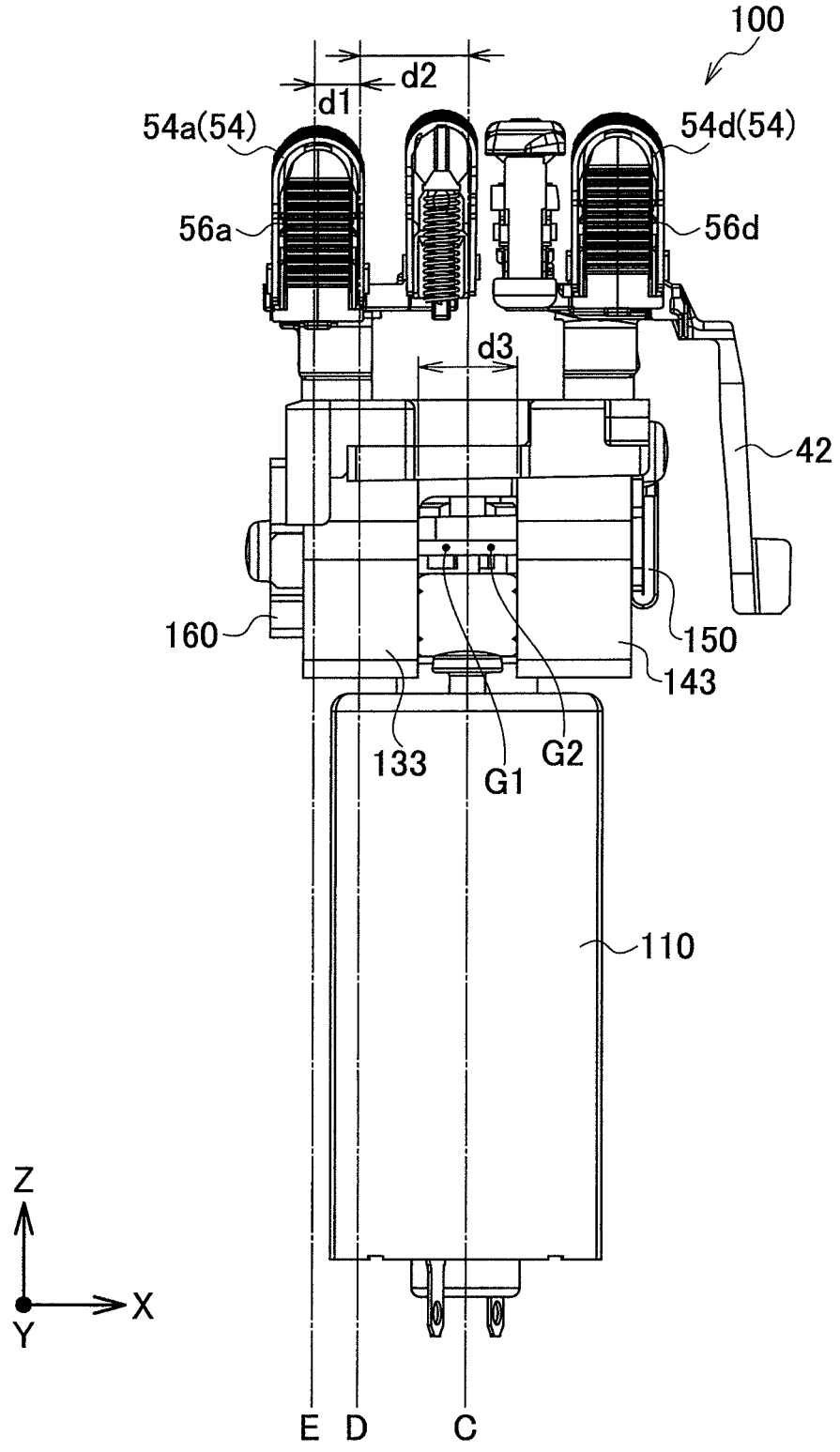
FIG. 9 is a side view of the driving mechanism according to the embodiment of the present invention.

The balance adjusters 150 and 160 are provided at the outermost portions of the driving elements 130 and 140 (at both ends in the front-rear direction X), respectively. In this embodiment, as shown in FIG. 9, the balance adjusters 150 and 160 are provided for the first and second driving elements (one of the elements) 130 and 140 so as to at least partially protrude from the second and first driving elements (the other element) 140 and 130 on the opposite sides to the first and second driving elements (the one element) 130 and 140, respectively. It is therefore possible to maximize the distance between the balance adjusters 150 and 160 (distance between the rotation axis C and each gravity center) while preventing the first and second driving blocks 200 and 210 from increasing in size. Accordingly, the balance adjusters 150 and 160 can be reduced in weight. Moreover, since the balance adjusters 150 and 160 can be reduced in weight, the balance adjusters 150 and 160 can be further miniaturized. This can further prevent the first and second driving blocks 200 and 210 from increasing in size.

Figure 10:
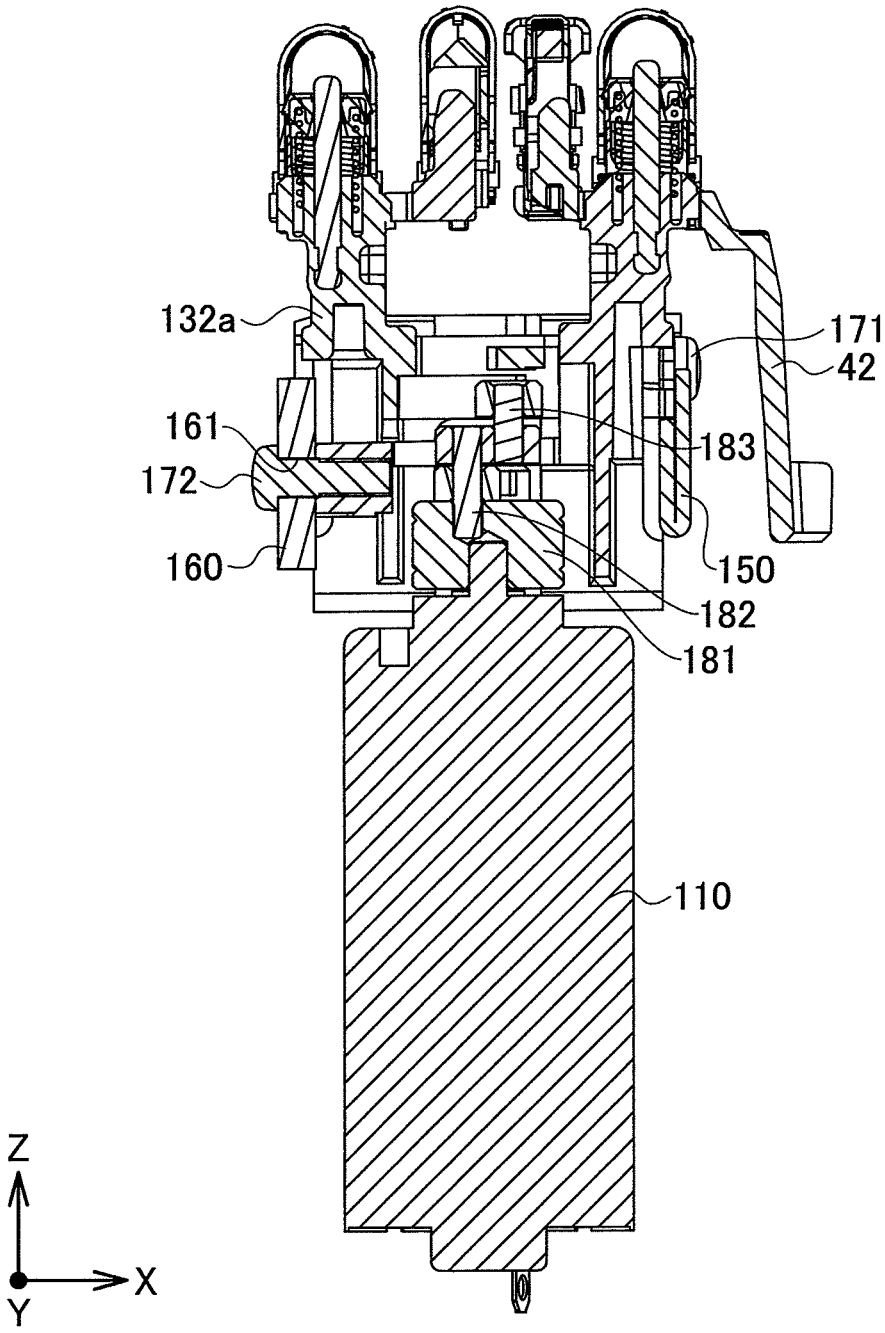
FIG. 10 is a sectional side view of the driving mechanism according to the embodiment of the present invention.

As shown in FIG. 10, the balance adjusters 150 and 160 are partially placed inside the outermost portions of the driving elements 130 and 140 (the both ends in the front-back direction X). This prevents the balance adjusters 150 and 160 from greatly protruding outward from the first and second driving elements 130 and 140. Furthermore, by arranging only the balance adjusters 150 and 160 slightly inside the first and second driving elements 130 and 140, it can be prevented that the positions of the points of action (gravity centers) of the balance adjusters 150 and 160 are shifted to the inside.

Since the balance adjusters 150 and 160 are located at the outermost portions of the driving elements 130 and 140, the balance adjusters 150 and 160 can be attached without any restriction due to the shapes of the first and second driving elements 130 and 140. It is therefore possible to increase the flexibility in the shapes of the first and second driving elements 130 and 140.

Furthermore, in this embodiment, the balance adjusters 150 and 160 have different shapes so as to have the gravity centers at the positions optimal to the first and second driving blocks 200 and 210.

To be specific, the balance adjuster 150 is formed by folding a substantially Y-shaped plate member, and the aforementioned attachment holes 151 are formed at both ends of upper part in the width direction.

On the other hand, the balance adjuster 160 is a plate member having a substantially T-shaped front profile, and the aforementioned attachment hole 161 is formed at the substantially center.

By providing the attachment holes 151 and the attachment hole 161 at different height positions, the balance adjusters 150 and 160 are located at a substantially same height position when attached to the first and second driving elements 130 and 140, so that the first and second driving blocks 200 and 210 can be miniaturized.

In this embodiment, the balance adjusters 150 and 160 are attached to the first and second driving elements 130 and 140 so that the thickness directions of the plate-shaped balance adjusters 150 and 160 match the front-rear direction X, respectively. It is therefore possible to maximize the distance between the points of action of the balance adjusters 150 and 160 (distance between each gravity center and the rotation axis C) while preventing an increase in dimension in the front-rear direction X, thus miniaturizing the first and second blocks 200 and 210.

Furthermore, in this embodiment, notches 152 are formed at both right and left sides of the balance adjuster 150, and notches 162 are formed at both right and left sides of the balance adjuster 160.

On the other hand, protrusions 132*d* are formed in the holding arms 132*c* of the first driving element 130 and are configured to be engaged with the notches 152 of the balance adjuster 150. Moreover, protrusions 142*d* are formed in the holding arms 142*c* of the second driving element 140 and are configured to be engaged with the notches 162 of the balance adjuster 160. These engagements allow the balance adjusters 150 and 160 to be respectively positioned and fixed to the driving elements 130 and 140 so as not to move up, down, right, and left.

Figure 18:
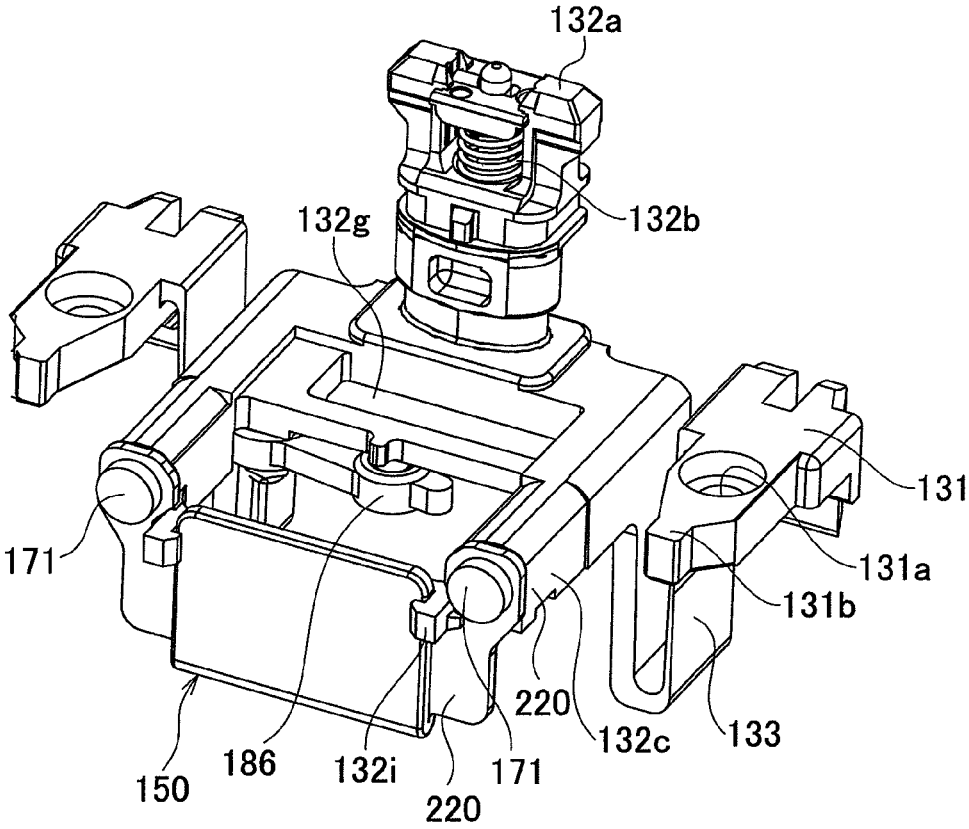
FIG. 18 is a perspective view showing a modification of the first driving element according to the embodiment of the present invention.

As shown in FIG. 18, the holding arms 132*c* may be provided with hooks 132*i* instead of the protrusions 132*d* so that the balance adjuster 150 is engaged with the hooks 132*i*. Alternatively, the balance adjusters may be attached to the driving elements with heat seal. Moreover, it is possible to provide holes instead of the notches so that the protrusions of the holding arms are engaged with the holes.

In this embodiment, the balance adjustment portions 220 and 230 provided for the first and second driving elements (one driving element) 130 and 140 are arranged so that the holding arms 132*c* and 142*c* and the balance adjusters 150 and 160 (at least a part of each of the balance adjustment portions 220 and 230) are slightly sit in spaces formed in the second and first driving elements (the other element) 140 and 130, respectively. This prevents the holding arms 132*c* and 142*c* from interfering with the driving elements 140 and 130 facing the same and prevents the pair of driving elements 130 and 140 from increasing in size, respectively.

Specifically, the first and second driving elements 130 and 140 are assembled to each other in such a way that the holding arms 132*c* of the first driving element 130 pass through shoulder spaces of the second driving element 140 (above the horizontal wall 142*j*) and the holding arms 142*c* of the second driving element 140 pass through space under the first driving element 130 (space between the pair of elastic legs 133: corresponding to a later described window 132*h* in this embodiment).

Furthermore, in this embodiment, the window 132*h* which allows the conversion mechanism 180 to be visible is provided.

Specifically, the pair of elastic legs 133 and the support frame 132 of the first driving element 130 are formed in a gate shape to provide the window 132*h* surrounded by the pair of elastic legs 133 and support frame 132 on three sides, thus allowing the inside (conversion mechanism 180) to be visible in the front-back direction X. Providing the window 132*h* in such a manner facilitates the work to assemble the driving blocks and the work to check the joint of the conversion mechanism 180.

Still furthermore, in this embodiment, the first driving element 130 is provided with a window 132*g*. The window 132*g* is composed of the support frame 132 and holding arms 132*c* to allow the inside (conversion mechanism 180) to be visible in the up-down direction Z. Moreover, the second driving element 140 is provided with a window 142*g* which is composed of the holding arms 142*c* and connecting arm 142*k* and allows the inside (conversion mechanism 180) to be visible in the up-down direction Z. By allowing the inside (conversion mechanism 180) to be visible in the up-down direction Z, the assembling and checking works are further facilitated.

In this embodiment, the balance adjusters 150 and 160 are made of metal (a material denser than the first and second driving elements 130 and 140). The balance adjusters 150 and 160 can be therefore miniaturized, and the head section 3 can be miniaturized as a whole. In this embodiment, as described above, the balance adjusters 150 and 160 are provided in a water-proof space (sealed space) 80 sealed so as to prevent body hair cut by the inner blades 54 or water used to wash the inner blades 54 from entering. This can prevent the balance adjusters 150 and 160 made of metal from rusting.

In this embodiment, the elastic legs 133 and 134 are placed so that central portions of the elastic legs 133 and 134 in the front-back direction X (an intermediate line in the direction orthogonal to the direction of reciprocation and the direction of attachment: a centerline D shown in FIG. 9) is closer to a line E of action of reaction force produced by the lifting springs (energization members) 132*b* and 142*b* than to the rotation axis C of the rotary motor 110 (d1<d2) when viewed in the right-left direction (direction of reciprocation of the driving elements) Y. Providing the elastic legs 133 and 143 closer to the line E of action of the reaction force due to the lifting springs 132*b* and 142*b* in such a manner can reduce the moments about the Y axis produced at the elastic legs 133 and 143 by the reaction force due to the lifting springs 132*b* and 142*b*, respectively. The elastic legs 133 and 143 are therefore prevented from being broken by stress concentration. When the elastic legs 133 and 143 are provided away from the rotation axis C of the rotary motor 110, the moments about the rotation axis C produced at the elastic legs 133 and 143 increase. In this embodiment, however, the reaction forces due to the lifting springs 132*b* and 142*b* are large, and setting d1<d2 can reduce the influence of vibration on the whole apparatus.

In the driving elements 130 and 140, walls 132*f* and 142*f* for reinforcement are formed, respectively. In this embodiment, the wall 132*f* is formed inside the line E of action of the reaction force due to the lifting spring 132*b* (rearward of the line E of action in the front-back direction X). The wall 142*f* is formed inside the line E of action of the reaction force due to the lifting spring 142*b* (forward of the line E of action in the front-back direction X).

By forming the walls 132*f* and 142*f* inside the lines E of action of reaction forces due to the lifting springs 132*b* and 142*b* in such a manner, it is possible to reduce the influence of the moment about the Y axis due to the walls 132*f* and 142*f* while preventing the driving elements 130 and 140 from being deformed by the reaction forces due to the lifting springs 132*b* and 142*b*.

The wall 132*f* is shorter than the elastic legs 133 so as not to block the window 132*h*. The window 132*h* is closed by attaching the balance adjuster 160. This can prevent that sound produced by the driving elements leaks out.

As described above, in this embodiment, the first and second driving blocks 200 and 210 are configured to include the balance adjustment portions 220 and 230 arranged on the opposite sides of the rotation axis C of the rotary motor 110 from the first and second driving elements 130 and 140, respectively.

Accordingly, the gravity centers G1 and G2 of the first and second driving blocks 200 and 210 can be set closer to the rotation line C of the rotary motor 110 than in the absence of the balance adjustment portions 220 and 230. In other words, it is possible to shorten the distance between the rotation axis C of the rotary motor 110 and the gravity center of each driving block and therefore reduce the moment about the rotation axis C at each driving element. This can reduce the vibration of the reciprocating electric shaver 1 including a plurality of driving elements arranged side by side.

Hereinabove, the preferred embodiment of the present invention is described. However, the present invention is not limited to the aforementioned embodiment, and various modifications thereof can be made.

What is claimed is:

1. A reciprocating electric shaver, comprising
- a rotary motor having a rotation axis;
- a conversion mechanism converting rotating motion of the rotary motor to reciprocating motion;
- and a pair of driving elements reciprocating in phases opposite to each other, wherein
- the pair of driving elements are individually connected to coupling members operating in conjunction with the reciprocating motions of the driving elements,
- each of the driving elements and the coupling member connected thereto defines a respective driving block, and
- each respective driving block includes a balance adjustment portion provided on an opposite side of the rotation axis of the rotary motor from the driving element, included in the respective driving block, when viewed in a direction of reciprocation of the driving elements.

2. The reciprocating electric shaver according to claim 1, wherein each balance adjustment portion includes an arm portion extending from each driving element included in the respective driving block to the opposite side of the rotation axis of the rotary motor from the driving element, included in the respective driving block, when viewed in the direction of reciprocation of the driving elements.

3. The reciprocating electric shaver according to claim 2, wherein the arm portions are located at different positions in a direction orthogonal to a direction of arrangement of the driving elements and the direction of reciprocation of the driving elements.

4. The reciprocating electric shaver according to claim 1, wherein at least a part of the balance adjustment portion provided for one of the pair of driving elements is placed in a space formed in the other driving element.

5. The reciprocating electric shaver according to claim 1, wherein at least a part of each balance adjustment portion is made of a material having a higher density than that of the driving elements.

6. The reciprocating electric shaver according to claim 5, wherein each balance adjustment portion is thin in a direction of arrangement of the pair of driving elements.

7. The reciprocating electric shaver according to claim 1, wherein
- in the reciprocating electric shaver, a space sealed to prevent intrusion of body hair, and the balance adjustment portions are provided in the sealed space, and
- each of the balance adjustment portions includes a balance adjuster formed separately from the driving elements, and
- the balance adjusters are individually attached to the paired driving elements in the direction of arrangement of the paired driving elements.

8. The reciprocating electric shaver according to claim 1, wherein each of the driving elements includes a window allowing the conversion mechanism to be visible.

9. The reciprocating electric shaver according to claim 1, wherein each of the balance adjustment portions is provided for one of the driving elements and protruded from the other driving element on the opposite side to the one driving element.

10. The reciprocating electric shaver according to claim 1, wherein in each driving element, an inner blade attachment portion to which an inner blade is detachably attached is formed, and an elastic leg portion supporting the inner blade attachment portion to allow the same to reciprocate is formed, the inner blade attachment portion is provided with an energization member energizing the inner blade in a direction of detachment of the inner blade, and an intermediate line of the elastic leg portion in a direction orthogonal to the direction of reciprocation and the direction of detachment is located between the rotation axis of the rotary motor and a line of action of reaction force due to the energization member when viewed in the direction of reciprocation of the driving elements.

11. The reciprocating electric shaver according to claim 10, wherein the intermediate line of the elastic leg portion in the direction orthogonal to the direction of reciprocation of the driving elements and the direction of detachment is located closer to the line of action than to the rotation axis of the rotary motor.

12. The reciprocating electric shaver according to claim 10, wherein the gravity center of each driving block is provided closer to the rotation axis of the rotary motor than the corresponding elastic leg portion when viewed in the direction of reciprocation of the driving elements.

* * * * *